US010568414B1

(12) United States Patent
Glattstein

(10) Patent No.: US 10,568,414 B1
(45) Date of Patent: Feb. 25, 2020

(54) EXPANDABLE FURNITURE PRODUCTS

(71) Applicant: Hillsdale Furniture LLC, Louisville, KY (US)

(72) Inventor: Uri Glattstein, Louisville, KY (US)

(73) Assignee: HILLSDALE FURNITURE LLC, Louisville, KY (US)

( * ) Notice: Subject to any disclaimer, the term of this patent is extended or adjusted under 35 U.S.C. 154(b) by 0 days.

(21) Appl. No.: 16/267,293

(22) Filed: Feb. 4, 2019

Related U.S. Application Data

(60) Provisional application No. 62/626,285, filed on Feb. 5, 2018.

(51) Int. Cl.

| | |
|---|---|
| ***A47B 1/08*** | (2006.01) |
| ***A47B 1/05*** | (2006.01) |
| ***A47B 46/00*** | (2006.01) |
| ***A47B 1/10*** | (2006.01) |

(52) U.S. Cl.
CPC ..... *A47B 1/08* (2013.01); *A47B 1/05* (2013.01); *A47B 1/10* (2013.01); *A47B 46/00* (2013.01); *A47B 2001/085* (2013.01)

(58) Field of Classification Search
CPC .... A47B 1/00; A47B 1/08; A47B 1/10; A47B 2001/085; A47B 46/00; A47B 17/036; A47B 17/065; A47B 17/03
See application file for complete search history.

(56) References Cited

U.S. PATENT DOCUMENTS

| | | | | |
|---|---|---|---|---|
| 603,715 | A | 5/1898 | Weston | |
| 2,470,165 | A | 5/1949 | Hartzler | |
| 2,558,465 | A | 6/1951 | Seymour | |
| 2,988,413 | A * | 6/1961 | Bergen | A47B 11/00 108/13 |
| 4,237,796 | A | 12/1980 | Baker | |
| 4,485,997 | A | 12/1984 | Potter | |
| D284,340 | S | 6/1986 | Berry | |
| 5,024,175 | A | 6/1991 | Epstein | |
| 5,101,523 | A | 4/1992 | Bright | |

(Continued)

FOREIGN PATENT DOCUMENTS

| | | |
|---|---|---|
| CN | 2865419 | 2/2007 |

OTHER PUBLICATIONS

Architonic, https://www.architonic.com/en/product/inmovement-collaborative-solutions-inmovement-pivot-table/1472928, retreived on Aug. 14, 2018.

(Continued)

*Primary Examiner* — Daniel J Rohrhoff

(74) *Attorney, Agent, or Firm* — Bryan Cave Leighton Paisner, LLP

(57) ABSTRACT

This disclosure relates to expandable furniture products that can be transformed into different configurations. The furniture products are equipped with an expansion system that enables the furniture products to be transformed between a compacted, space-saving configuration and an expanded configuration that increases the surface area of the furniture products. The expansion system integrated into the furniture products permits the furniture products to easily switch between the compacted configuration and the expanded configuration, and allows the furniture products to be fashioned in various ways when arranged in the expanded configuration.

16 Claims, 20 Drawing Sheets

(56) References Cited

U.S. PATENT DOCUMENTS

| | | | | |
|---|---|---|---|---|
| 5,535,684 | A | 7/1996 | John | |
| 5,562,049 | A | 10/1996 | Hoffman | |
| 5,588,377 | A | 12/1996 | Fahmian | |
| 5,666,887 | A | 9/1997 | Grabowski | |
| 5,683,154 | A * | 11/1997 | Chang | A47B 17/065 108/94 |
| 5,718,475 | A | 2/1998 | Watts | |
| 5,743,603 | A * | 4/1998 | Kelley | A47B 21/00 312/195 |
| 5,768,796 | A | 6/1998 | Lanus | |
| 5,947,035 | A * | 9/1999 | Chang | A47B 17/06 108/143 |
| 6,659,543 | B2 | 12/2003 | McCutcheon | |
| 6,688,563 | B1 | 2/2004 | Waxham | |
| 6,749,158 | B2 | 6/2004 | Timm | |
| 6,955,345 | B2 | 10/2005 | Kato | |
| 6,997,114 | B2 * | 2/2006 | Chang | A47B 17/06 108/64 |
| 7,331,556 | B1 | 2/2008 | Brennan | |
| 7,469,644 | B2 | 12/2008 | Tseng | |
| 7,481,170 | B2 | 1/2009 | Sommerfield | |
| D588,145 | S | 3/2009 | Benden | |
| 7,568,774 | B1 | 8/2009 | Jannetides | |
| 8,516,966 | B1 | 8/2013 | Evans | |
| 8,517,190 | B2 | 8/2013 | Polizzi | |
| 8,650,066 | B2 | 2/2014 | Shah | |
| 9,055,811 | B2 | 6/2015 | Reithler | |
| 9,788,646 | B2 * | 10/2017 | Halde | A47B 17/03 |
| 9,808,082 | B1 | 11/2017 | Neslon | |
| 10,021,968 | B2 | 7/2018 | Liu | |
| 2006/0284529 | A1 * | 12/2006 | Milutinovics | A47B 9/10 312/319.8 |
| 2007/0157857 | A1 | 7/2007 | Bottemiller | |
| 2007/0169673 | A1 * | 7/2007 | Tseng | A47B 1/04 108/65 |
| 2012/0298017 | A1 * | 11/2012 | Chen | A47B 17/065 108/91 |
| 2013/0284075 | A1 * | 10/2013 | Reithler | A47B 17/03 108/91 |
| 2016/0353406 | A1 | 12/2016 | Gianoukos | |
| 2017/0245638 | A1 * | 8/2017 | Caratiola | A47B 9/00 |
| 2017/0367475 | A1 * | 12/2017 | Carrera Gonzalez | A47B 1/05 |

OTHER PUBLICATIONS

Gilda, https://www.miliboo.co.uk/gilda-scandinavian-designer-white-oak-pivoting-desk-41197.html, retreived on Aug. 14, 2018.

Paragon, https://www.worthingtondirect.com/desks/sit2048-switchit-pivoting-desk-return-48-w-x-20-d.htm, retreived on Aug. 14, 2018.

Lublin, https://inhabitat.com/mebel-furniture-lublin-pivot-table/, retreived on Aug. 14, 2018.

Crate, https://www.crateandbarrel.com/revolve-48-round-adjustable-height-dining-table/s672566?localedetail=US&a=1552&campaignid=751206882&adgroupid=43087155321&targetid=pla-425837906566&pla_sku=672566&pcat=FURN&ag=adult&scid=scplp672566&sc_intid=672566&gclid=EAIaIQobChMl1p2SwcHr3AIVwrrACh3k2QCoEAQYBCABEglkMPD_BwE&gclsrc=aw.ds, retreived on Aug. 13, 2018.

Forster, http://www.euroweldgroup.lt/home/welding-table-systems/special-welding-tables/rotating-welding-jigs/?lang=en, retreived on Aug. 13, 2018.

Loveseat, https://www.loveseat.com/i/table-w-rotating-top/, retreived on Aug. 13, 2018.

HowardLorton, http://howardlorton.com/!trash/test1/lunar-cocktail-table-55-x-20-x-19-360-rotating-top-casters-w/, retreived on Aug. 13, 2018.

* cited by examiner

EXPANDABLE FURNITURE PRODUCTS

CROSS-REFERENCE TO RELATED APPLICATIONS

This application claims priority to, and the benefit of, U.S. Provisional Application No. 62/626,285 filed on Feb. 5, 2018

TECHNICAL FIELD

The present disclosure is directed to furniture products that have expandable surfaces and furniture products that can reconfigured into different configurations.

BACKGROUND

Many different furniture items, such as desks and tables, have top surfaces that can be used to be used to support items (e.g., books, food, cups, etc.) and for various other purposes. Having a large top surface can be beneficial in many scenarios in which an individual desires to have large surface areas. However, a furniture item that has a large upper surface can occupy a large amount of space and/or floor area in a room. In addition, furniture items having large upper surfaces can be difficult to store. In many cases, tools or hardware (e.g., bolts or screws) may be required to dissemble the furniture items before such items can be stored.

BRIEF DESCRIPTION OF DRAWINGS

To facilitate further description of the embodiments, the following drawings are provided, in which like references are intended to refer to like or corresponding parts, and in which.

DETAILED DESCRIPTION OF EXEMPLARY EMBODIMENTS

Figure 1A:
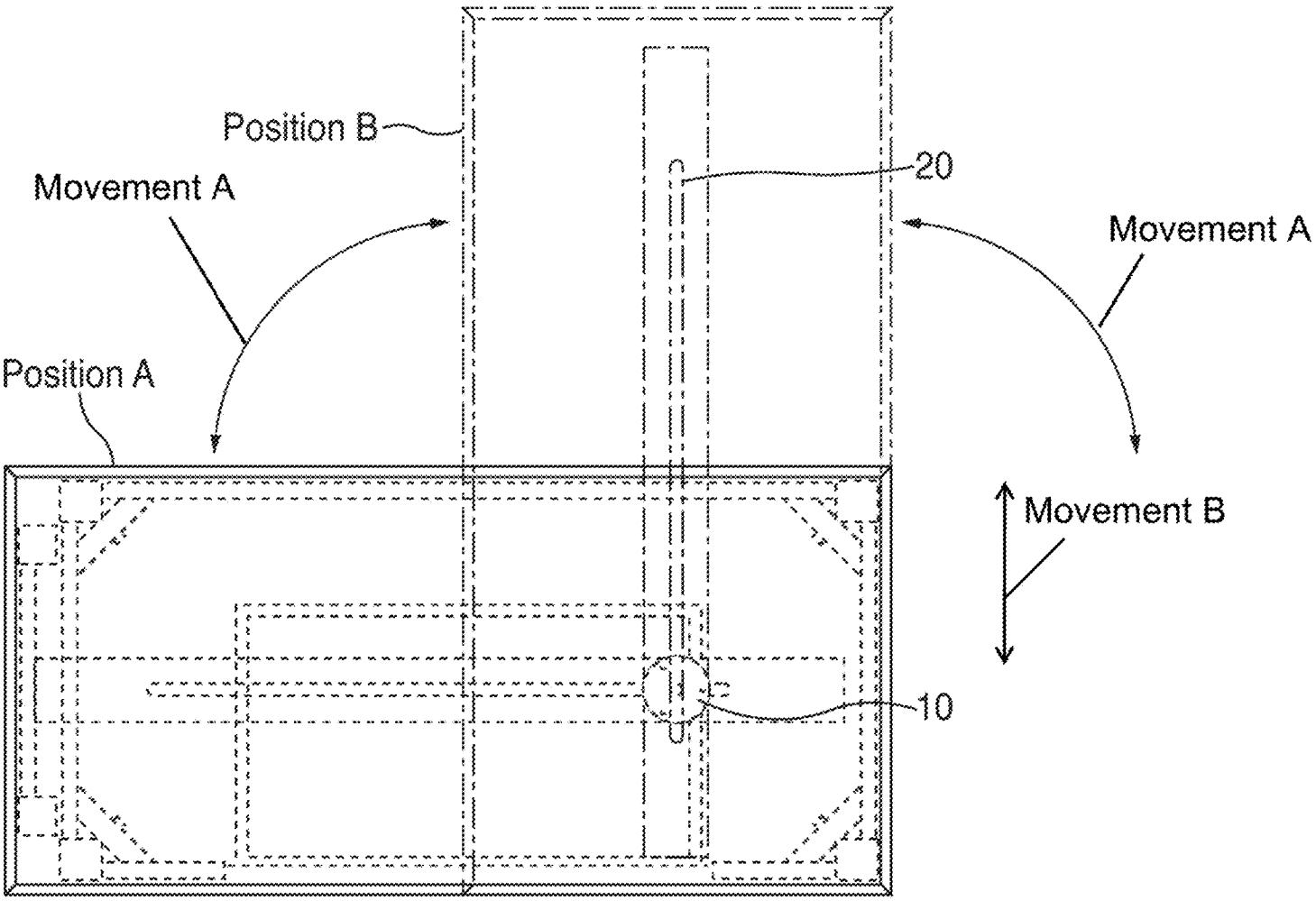
FIG. 1A is a top plan view of an exemplary desk according to certain embodiments.

The present disclosure relates to expandable furniture products that can be transformed into different configurations. The furniture products are equipped with a novel expansion system that enables the furniture products to be transformed between a compacted, space-saving configuration and an expanded configuration that increases the available surface area of the furniture products. For example, the furniture products initially can be arranged in a compacted configuration that has confined dimensions with less available surface area, and which minimizes the floor areas occupied by the furniture products. The furniture products can be transformed into an expanded configuration that enlarges the dimensions of the furniture products, increases the surface areas of the furniture products, and increases the floor areas occupied by the furniture products. The novel expansion system integrated into the furniture products permits the furniture products to easily switch between the compacted configuration and the expanded configuration, and allows the furniture products to be fashioned in various ways when arranged in the expanded configuration (e.g., fashioned into an L-shape configuration, an I-shape configuration, a V-shape configuration, a T-shape configuration, and/or another configuration).

The principles discussed herein can be applied to any type of furniture product. For example, the principles discussed herein can be applied to tables (e.g., cocktail tables, coffee tables, dining tables, refractory tables, drop-leaf tables, end tables, kitchen tables, and other types of tables), desks (e.g., writing desks, night stands, office desks, computer desks, credenza desks, and other types of desks), entertainment stands, work benches, seats (e.g., bench seats and chairs), dressers, bar units (e.g., mini bars, countertop bars, wine bars, and other types of bar units), storage units, bookcases, shelving products, chests, beds, drawing boards, garden furniture, pet crates, and other types of furniture products. Any of the aforementioned furniture products (and/or other furniture products) can be equipped with the expansion system described herein, which would permit the furniture products to transform between compacted configurations and the expanded configurations. The figures included with this disclosure provide details for exemplary furniture products, which include tables, desks, kitchen islands, bar units, and pet crates.

In certain embodiments, the top surfaces of the furniture products can include a top panel and a bottom panel that are coupled together via the expansion system. In certain embodiments, both the top panel and the bottom panel are substantially flat and planar. When a furniture product is arranged in a compacted configuration, the top panel can be situated on top of the bottom panel and/or can rest on the bottom panel. In this arrangement, the upper surface of the top panel is exposed and can provide available surface area for resting items or performing functions, while the bottom panel is substantially concealed beneath the top panel. In certain embodiments, the top panel is movably coupled to the bottom panel via the expansion system, such that the top panel can be rotated and/or moved into an expanded configuration. When the furniture product is arranged in the expanded configuration, at least a portion of the bottom panel top surface is exposed and provides additional surface area for the furniture product. The bottom panel can correspond to a surface that is integral to the furniture product itself, and/or can be a separate structure that is attached to the furniture product.

The configuration of the expansion system can vary. In certain embodiments, the expansion system includes a rotational plate and a channel guide. The rotational plate can be a circular plate that enables the top panel to rotate about an axis that extends through the center of the plate. In certain embodiments, a base portion of the rotational plate can be integrated into the bottom panel, and an upwardly extending coupling portion located on the top side of the rotational plate can extend through the bottom surface of the top panel to movably couple the top panel to the bottom panel. In other embodiments, the expansion system can be arranged in an inverse manner, such that the circular base of the rotational plate can be integrated into the top panel, and a downwardly extending coupling portion can extend through the top surface of the bottom panel to movably couple the top panel to the bottom panel. Regardless of how the expansion system is arranged, the rotational plate can serve to couple the top panel to the bottom panel, and to enable the top panel to rotate about an axis that extends through the center of the rotational plate. In certain embodiments, the top panel is configured to rotate 360 degrees about or around the coupling portion.

The channel guide of the expansion system represents a groove, conduit, channel, indentation, track, or other structure that is integrated into, and extends along, the bottom surface of the top panel. In certain embodiments, the channel guide can be separate structure that is attached to the bottom surface of the top panel. The channel guide can alternatively, or additionally, be part of the top panel itself (e.g., carved into the bottom surface of the top panel).

The channel guide serves to direct or guide the movement of the top panel in a desired direction. For example, the top panel initially can be rotated to any desired angle about the axis extending through the center of the rotation plate. Once the top panel is rotated to the desired angle, the top panel can be pulled outwardly from the bottom panel and/or pushed inwardly toward the bottom panel. The channel guide on the bottom surface of the top panel receives the coupling portion of the rotational plate and uses the connection between the coupling portion and the channel guide to direct the movement of the top panel as the top panel is being pulled outward and/or pushed inward. In this manner, the channel guide enables the top panel of the furniture products to move in a direction along a line or plane that extends through the center of the rotational plate. The movability provided by the rotational plate and channel guide permits the furniture products to be arranged in various shapes as desired by the individual who is transforming the furniture products.

It should be recognized that other types of expansion systems can be integrated into the furniture products to enable the furniture products to transform between the compacted configurations and the expanded configurations. In fact, in certain embodiments, the furniture products may be freely transformed without the assistance of an expansion system. For example, in certain embodiments, the top panel may not be directly coupled to the bottom panel and can be rotated and arranged freely as desired.

The furniture products can include one or more support members that serve to support the top surface of the furniture products (including the top and bottom panels) and/or that enable the furniture products to rest on the floor in a steady and stable position. Exemplary support members may include downwardly extending leg members, leg structures, wall structures, and/or other suitable structures that are capable of supporting the furniture products.

In certain embodiments, one or more additional support members may be attached to the top panel to provide assistance with supporting the top panel when the furniture products are arranged in the expanded configurations. For example, when the furniture products are arranged in the expanded position, a support structure that extends downwardly to the floor from an outer edge of the top panel, which is no longer situated on top of the bottom panel, can provide support for the top panel. Any type of support member can be attached to the top panel (e.g., any type of leg or support structure that extends to the floor to support the weight of the top panel).

In certain embodiments, the bottom portions of the additional support members can include wheels, gliding members, and/or other movement-enabling structures that permit the top panel to move easily along a floor surface or other surface when the furniture product is being converted between the compacted configuration and the expanded configuration (e.g., when the top panel is being rotated about the axis of the rotational plate and/or moved along the channel guide). In certain embodiments, the support members are configured to be retractable and/or detachable, such that they can be retracted or removed when such is desirable (e.g., when the furniture product is arranged in a compacted configuration and/or when the bottom panel can sufficiently support the top panel without the additional support members).

The configurations of the top surfaces of the furniture products can be varied in many ways. For example, the shapes of the top surfaces (including both the top and bottom panels) can vary according to different embodiments. Generally speaking, the top surfaces can be arranged in any shape and any size. For example, the top surfaces can be arranged in rectangular or square shapes in certain embodiments. The top surfaces can be arranged in other shapes as well (e.g., circular, triangular, pentagonal, hexagonal, polygonal, etc.). In certain embodiments, the shapes and/or sizes of the top panels and the bottom panels are the same or substantially the same. In other embodiments, the shapes and/or sizes of the top panels and the bottom panels can be different from one another.

The furniture products (including the top panels, bottom panels, support members, etc.) can be constructed of any appropriate material. For example, furniture products or portions thereof may be constructed of and/or include: wood, polymers (e.g., plastics), metals and/or fabrics (e.g., cloths, leathers, and/or textiles). In certain embodiments, the main body of the furniture product (e.g., including the top surfaces and support members) can be constructed of rigid materials, such as wood, metals, and plastics, and, optionally, fabrics can be attached to the rigid structures. In certain embodiments, the rotational plate can be constructed of metal, plastic, and/or other rigid materials.

The furniture products described in this disclosure can be manufactured using any suitable technique. The various components of the furniture products (e.g., rotational plates, support members, top surfaces, etc.) can be constructed using different manufacturing techniques, and the components can then be combined and assembled to create the furniture products. Exemplary techniques that may be utilized to manufacture the furniture products and/or its components include any or all of the following: wood-cutting techniques, molding techniques (e.g., blow-molding, injection-molding and compression-molding techniques), casting techniques (e.g., in which liquid material is poured into a mold), three-dimensional (3D) printing and additive manufacturing techniques, and machining techniques (e.g., in which a piece of material is cut into a desired final shape and size).

The inventive principles discussed herein provide a variety of advantages. Importantly, furniture products are provided that can be transformed into compacted, space-saving configurations when more space is needed, and that can also be transformed into expanded configurations when additional surface area is needed. Unlike conventional furniture products that are expandable, the furniture products described herein are not limited to a specific expansion configuration. Rather, the expansion system incorporated into the furniture products permits the furniture products to be expanded into various shapes (e.g., L-shapes, I-shapes, V-shapes, etc.). This means that an individual is able to customize the amount of surface area that is provided, as well as the amount of floor space that is occupied by the furniture products. The furniture products can also be arranged to accommodate the dimensions of rooms and/or available floor space. Other advantages relate to the ease in which the expansion system permits the furniture products to be transformed. No tools or hardware (e.g., bolts or screws) are required to transform the furniture products. In certain embodiments, the furniture products can be transformed by simply rotating the top panel to a desired angle, and sliding the top panel into a desired position along the channel guide, which is integrated into the bottom surface of the top panel. As explained above, the top panel can include support members that include wheels, glides, and/or other movement-enabling structures that allow the top panel to easily and freely be moved along a floor surface, and which provide support for the top panel when the furniture products are arranged in extended configurations.

It should be recognized that the embodiments described in this disclosure can be combined in various ways. Any aspect or feature that is described in connection with one embodiment can be incorporated into any other embodiment mentioned in this disclosure. It should also be recognized that the inventive principles described in this disclosure are not limited to the particular embodiments illustrated in the figures.

In certain embodiments, a furniture product is provided comprising: an expandable surface that includes a bottom panel; and a top panel that is situated above the bottom panel when the furniture product is arranged in a compacted configuration, and the top panel is moveable to transform the furniture product into an expanded configuration; wherein: a bottom surface of the top panel includes a channel guide; a top surface of the bottom panel includes a rotational plate; the rotational plate includes a coupling portion that is received in the channel guide of the top panel to couple the bottom panel and the top panel; a connection the between channel guide and the rotational plate enables the top panel to be moved between the compacted configuration and the expanded configuration; the connection between the rotational plate and the channel guide enables the top panel to rotate about an axis extending through the rotational plate, and further enables the top panel to move along the channel guide in a plane that is substantially parallel to a floor surface supporting the furniture product.

Figure 1C:
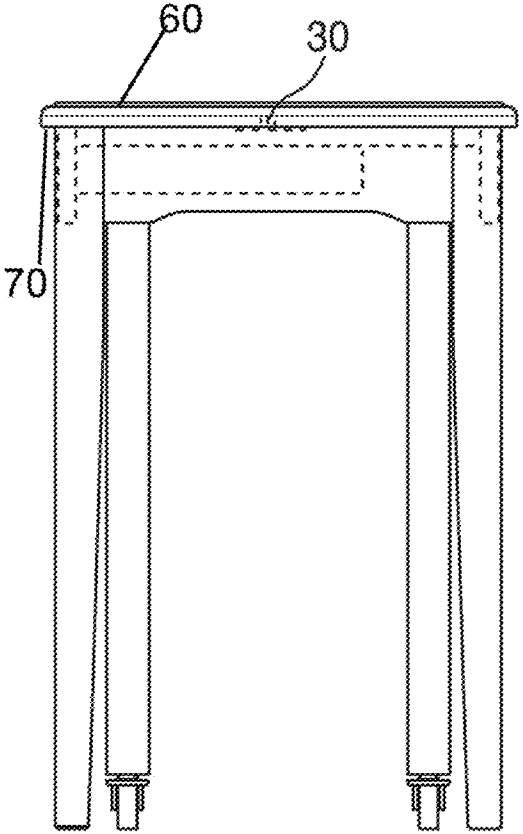
FIG. 1C is a right side view of the exemplary desk shown in FIG. 1A according to certain embodiments.
Figure 1B:
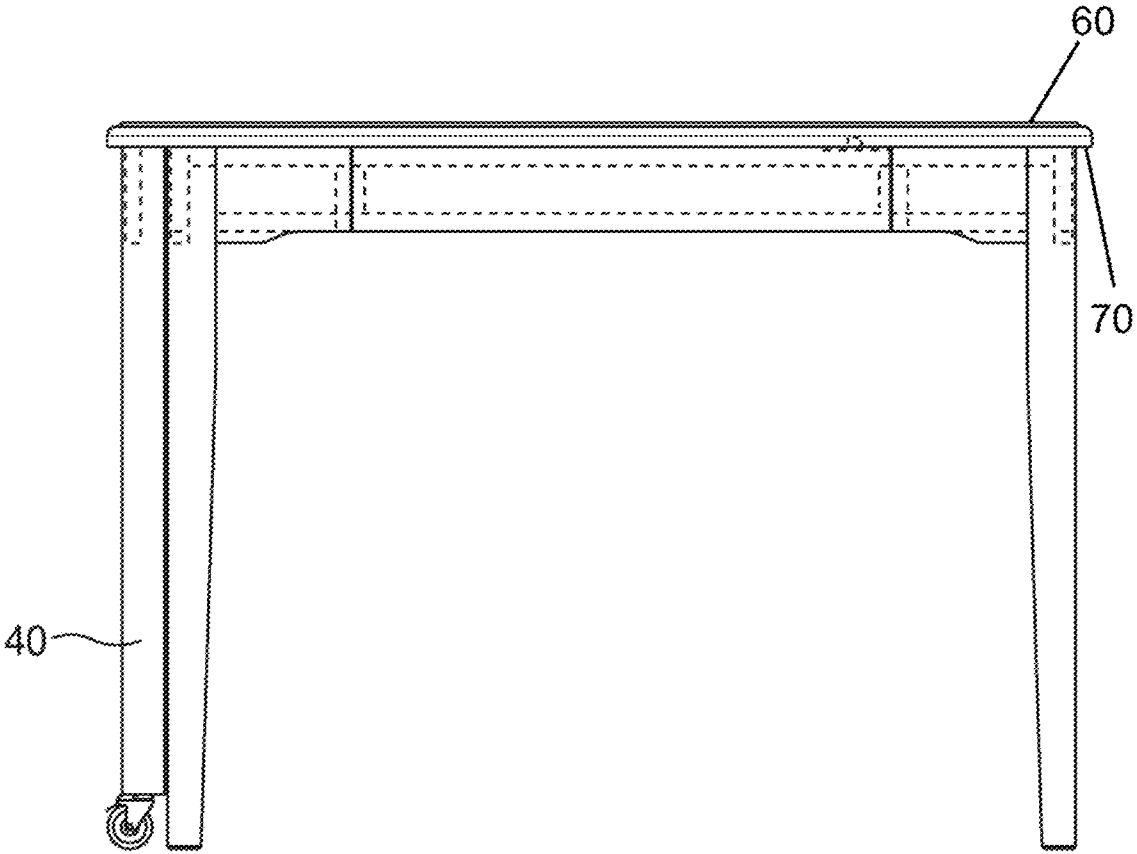
FIG. 1B is a front view of the exemplary desk shown in FIG. 1A according to certain embodiments.

Moving on to the figures, FIGS. 1A-1C illustrate an exemplary desk according to certain embodiments. FIG. 1A is a top plan view of the desk. FIG. 1B is a front view of the desk. FIG. 1C is a right side view of the desk.

Figure 2A:
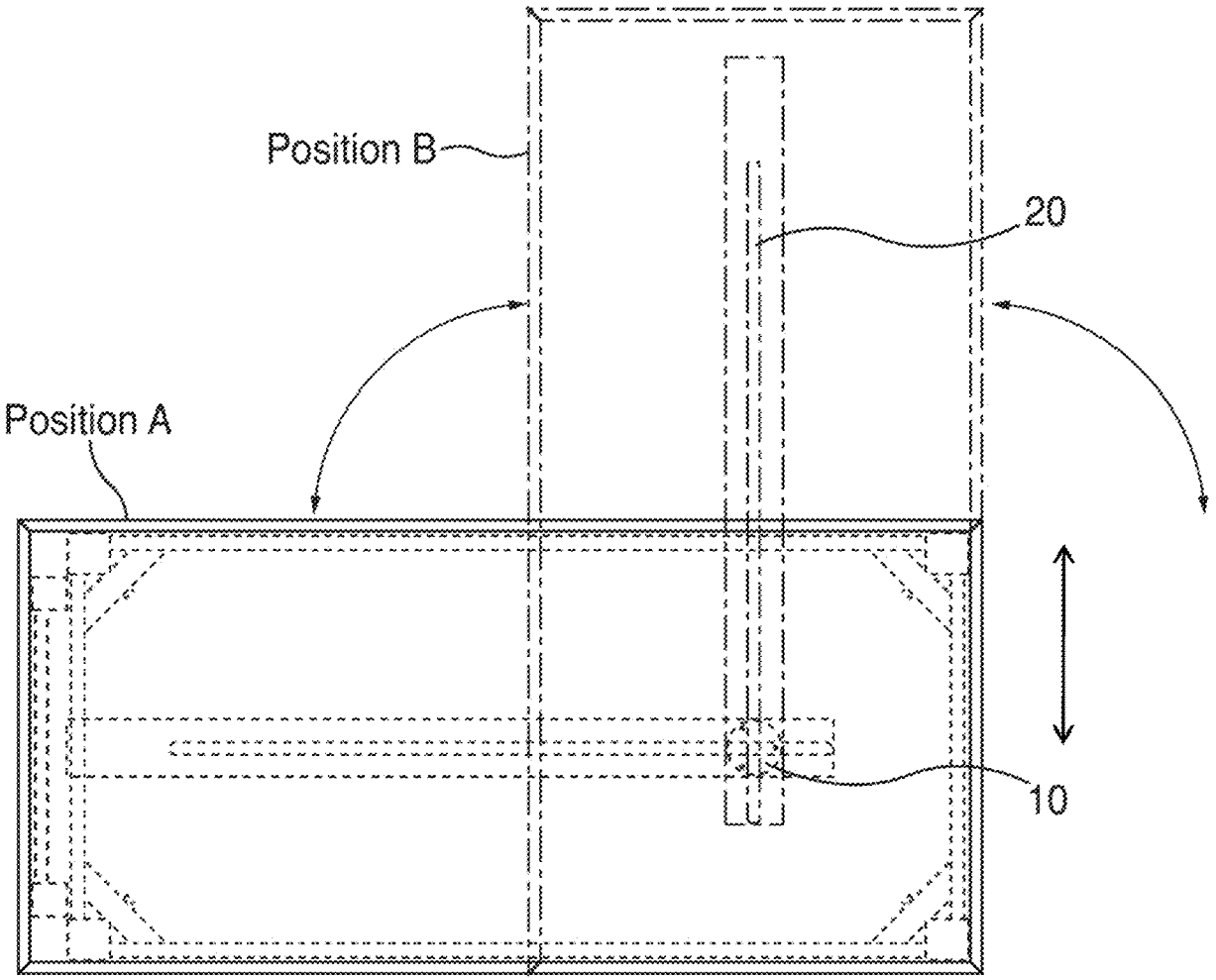
FIG. 2A is a top plan view of an exemplary table according to certain embodiments.
Figure 2C:
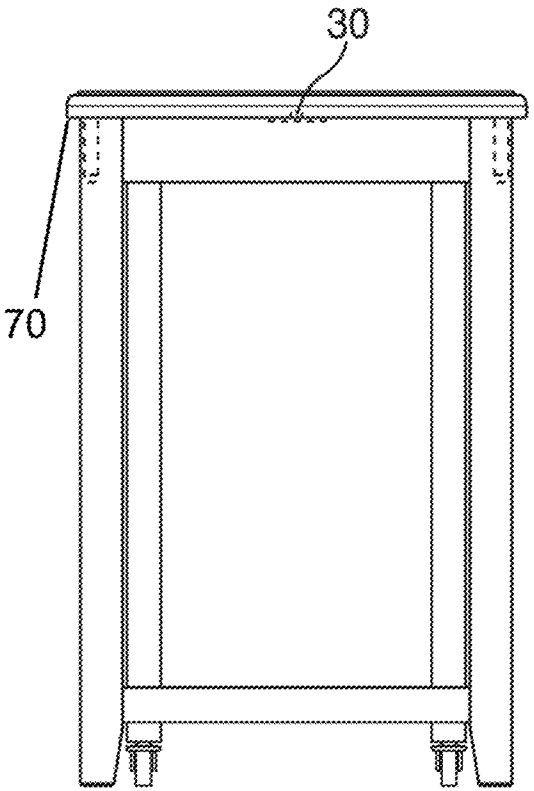
FIG. 2C is a right side view of the exemplary table shown in FIG. 2A according to certain embodiments.
Figure 2B:
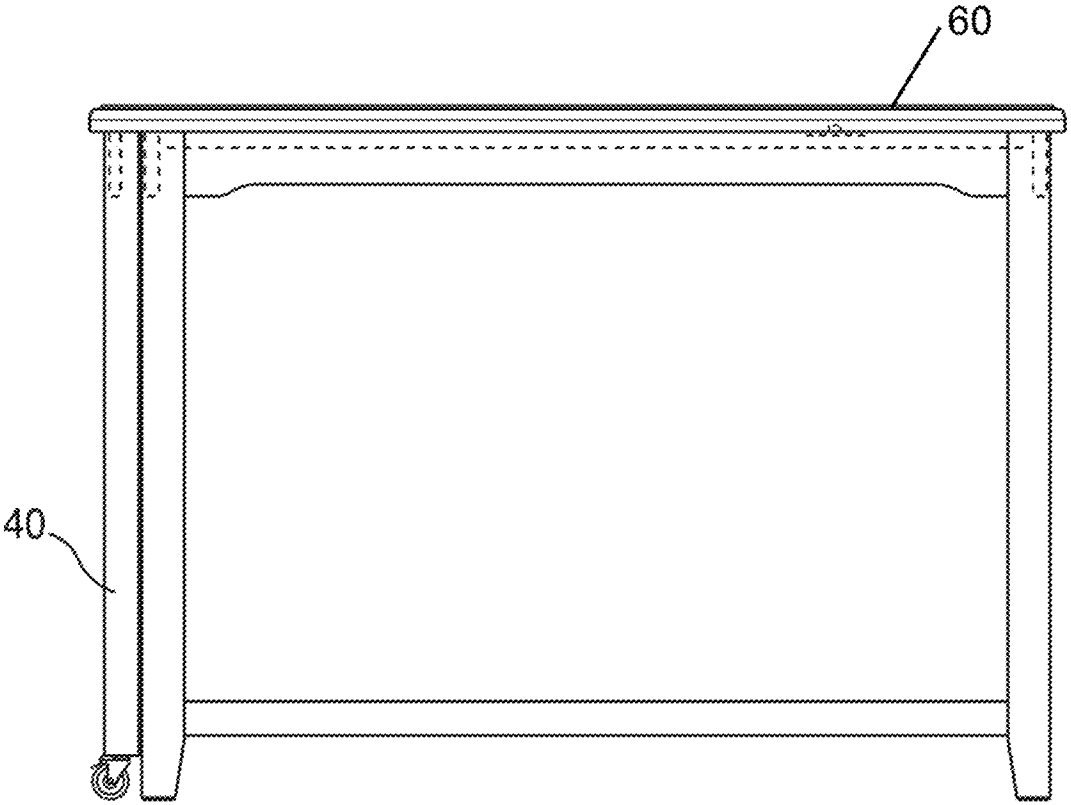
FIG. 2B is a front view of the exemplary table shown in FIG. 2A according to certain embodiments.

FIGS. 2A-2C illustrate an exemplary table according to certain embodiments. FIG. 2A is a top plan view of the table. FIG. 2B is a front view of the table. FIG. 2C is a right side view of the table.

Figure 3A:
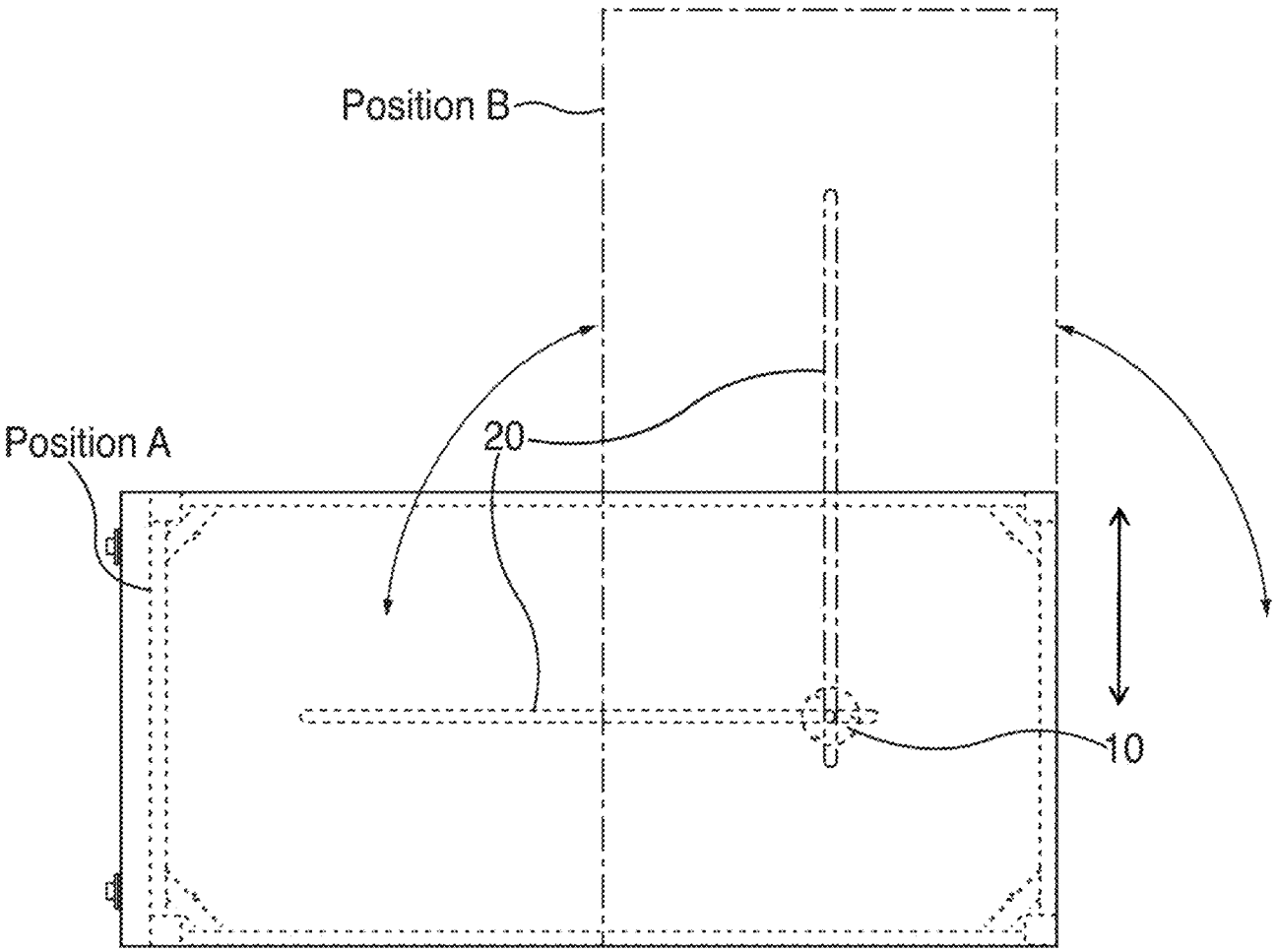
FIG. 3A is a top plan view of an exemplary cocktail table according to certain embodiments.
Figure 3C:
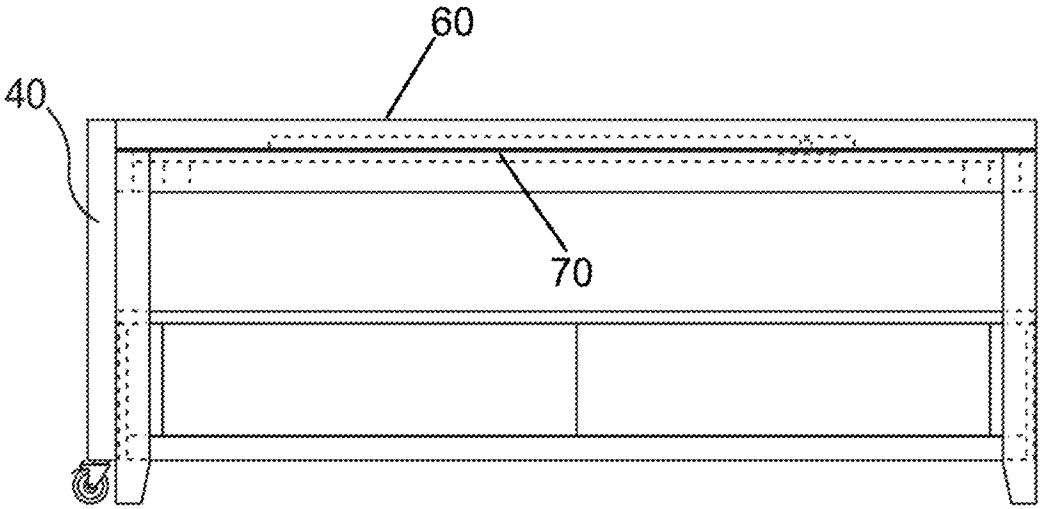
FIG. 3C is a front view of the exemplary cocktail table shown in FIG. 3A according to certain embodiments.
Figure 3D:
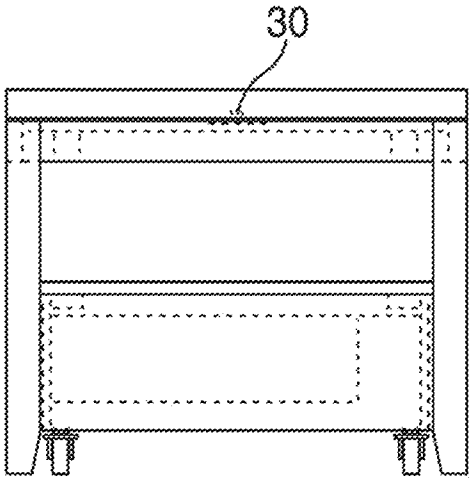
FIG. 3D is a right side view of the exemplary cocktail table shown in FIG. 3A according to certain embodiments.
Figure 3B:
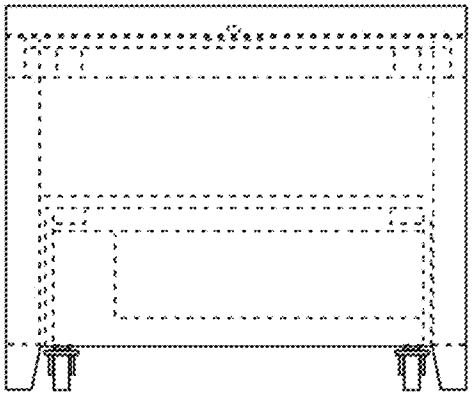
FIG. 3B is a left side view of the exemplary cocktail table shown in FIG. 3A according to certain embodiments.

FIGS. 3A-3D illustrate an exemplary cocktail table according to certain embodiments. FIG. 3A is a top plan view of the cocktail table. FIG. 3B is a left side view of the cocktail table. FIG. 3C is a front view of the cocktail table. FIG. 3D is a right side view of the cocktail table.

Figure 4B:
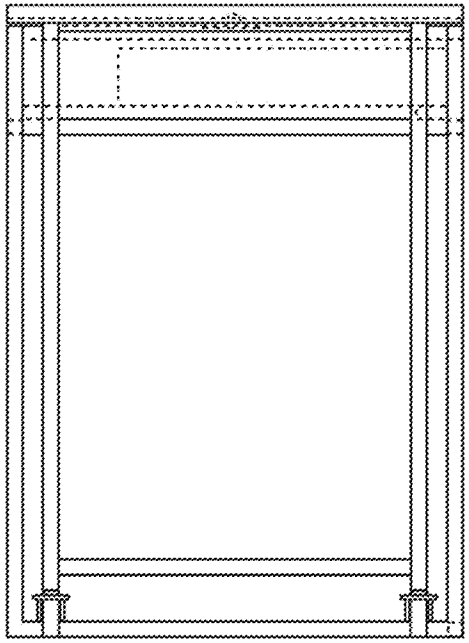
FIG. 4B is a left side view of the exemplary desk shown in FIG. 4A according to certain embodiments.
Figure 4A:
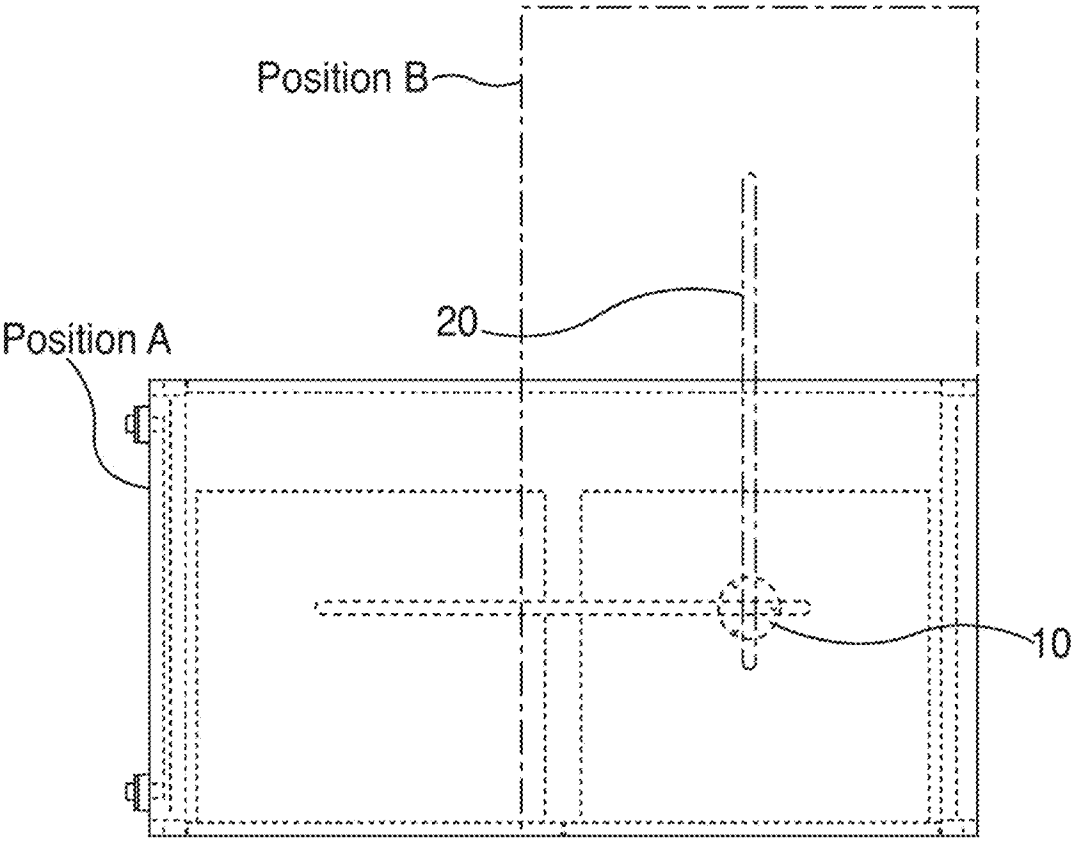
FIG. 4A is a top plan view of another exemplary desk according to certain embodiments.
Figure 4D:
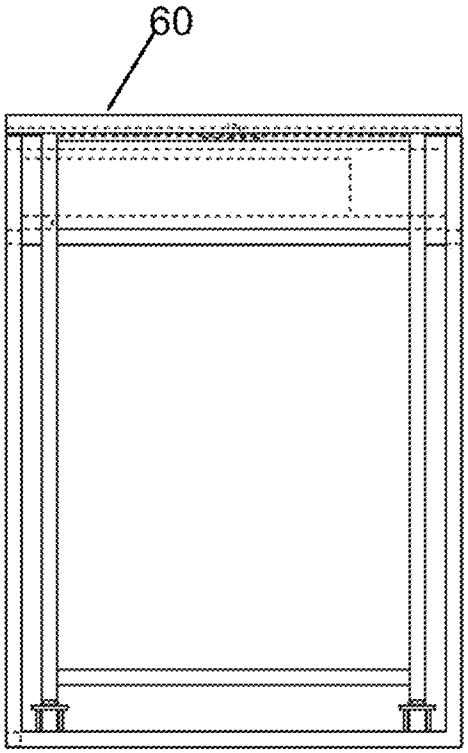
FIG. 4D is a right side view of the exemplary desk shown in FIG. 4A according to certain embodiments.
Figure 4C:
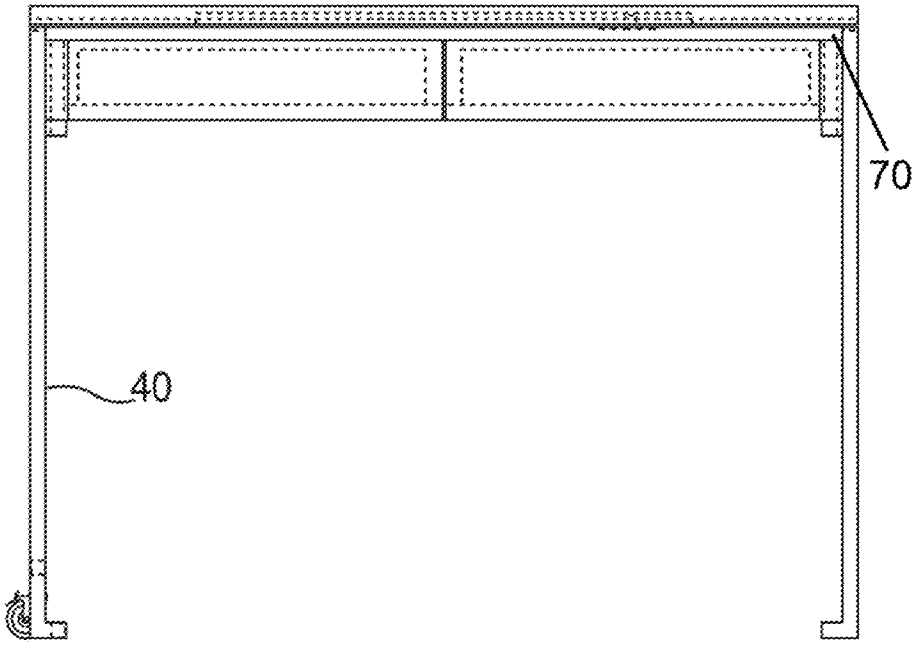
FIG. 4C is a front view of the exemplary desk shown in FIG. 4A according to certain embodiments.

FIGS. 4A-4D illustrate another exemplary desk according to certain embodiments. FIG. 4A is a top plan view of the desk. FIG. 4B is a left side view of the desk. FIG. 4C is a front view of the desk. FIG. 4D is a right side view of the desk.

Figure 5A:
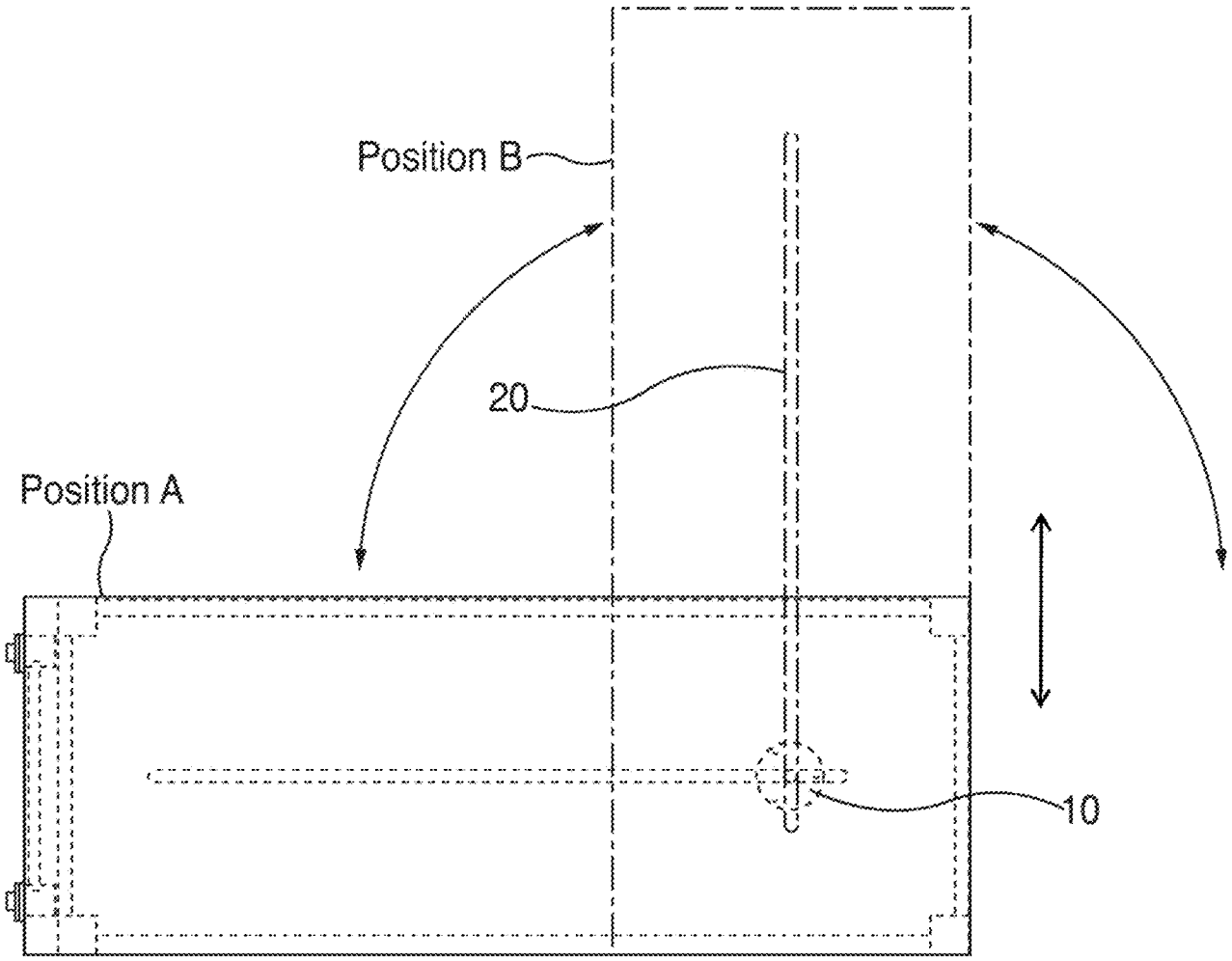
FIG. 5A is a top plan view of an exemplary bar unit according to certain embodiments.
Figure 5C:
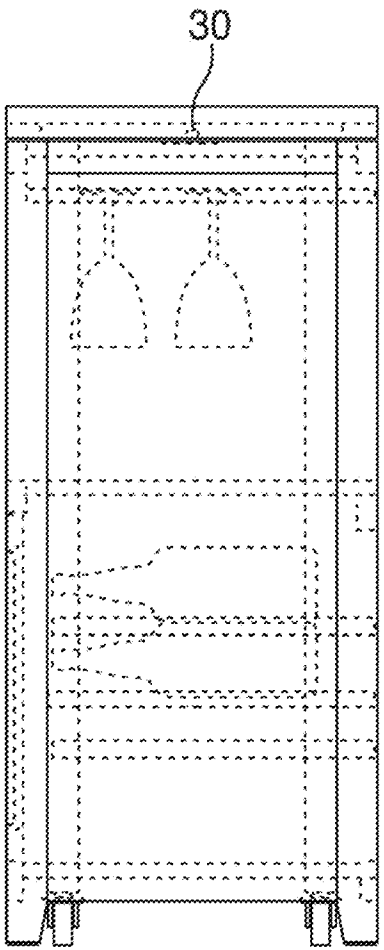
FIG. 5C is a right side view of the exemplary bar unit shown in FIG. 5A according to certain embodiments.
Figure 5B:
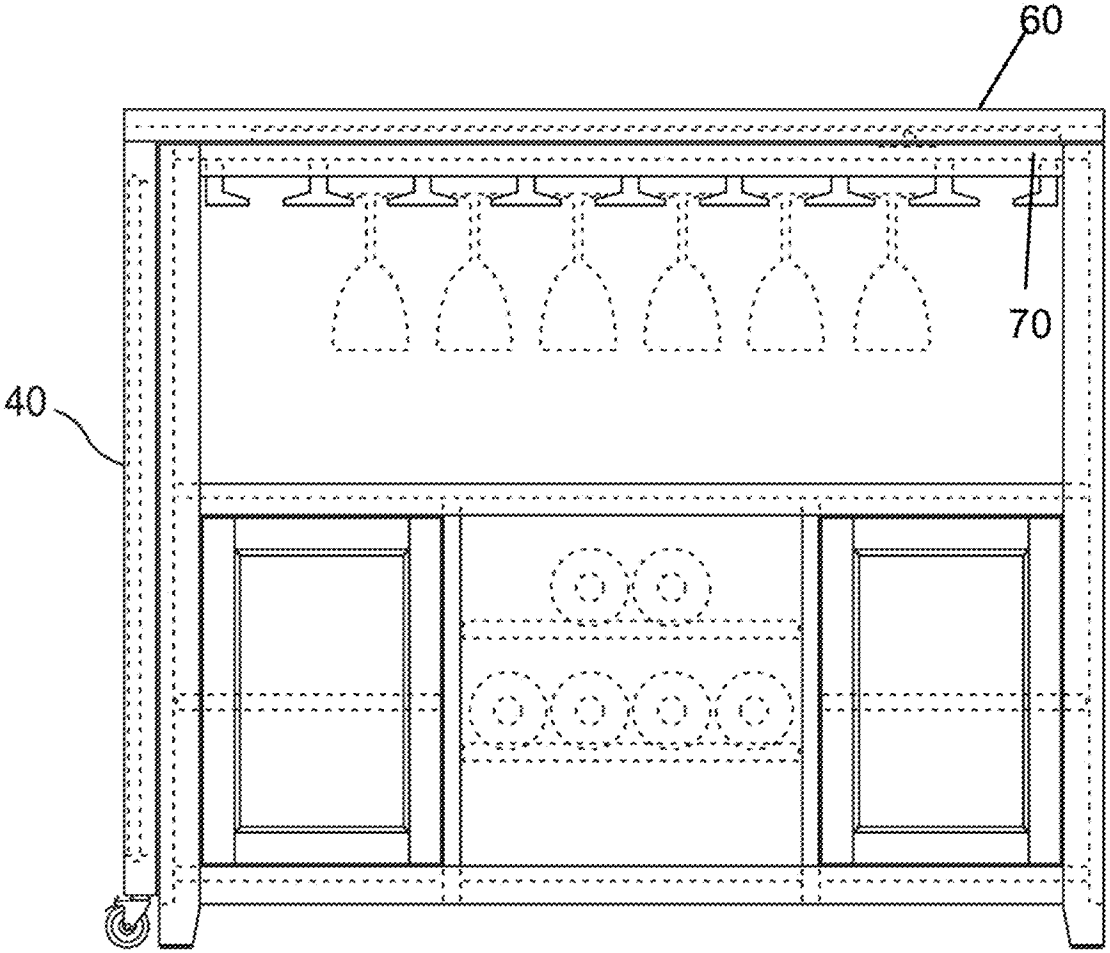
FIG. 5B is a front view of the exemplary bar unit shown in FIG. 5A according to certain embodiments.

FIGS. 5A-5C illustrate an exemplary bar unit according to certain embodiments. FIG. 5A is a top plan view of the bar unit. FIG. 5B is a front view of the bar unit. FIG. 5C is a right side view of the bar unit.

Figure 6B:
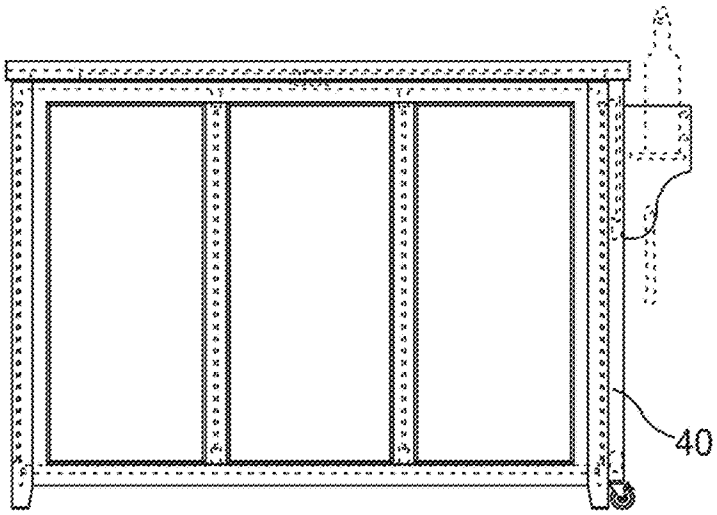
FIG. 6B is a rear view of the exemplary kitchen island shown in FIG. 6A according to certain embodiments.
Figure 6A:
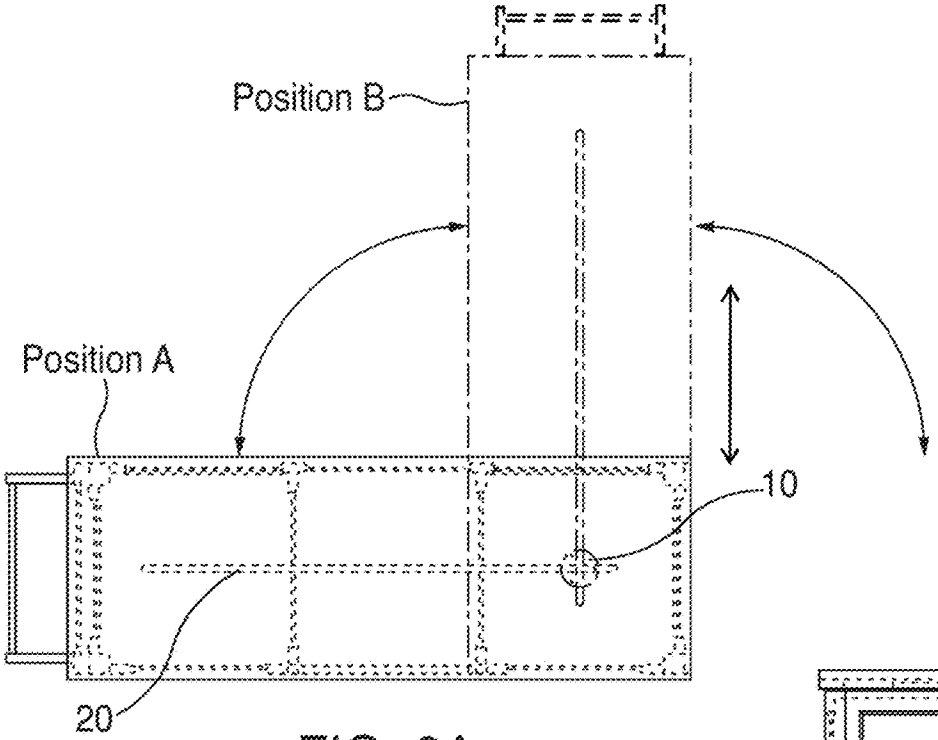
FIG. 6A is a top plan view of an exemplary kitchen island according to certain embodiments.
Figure 6E:
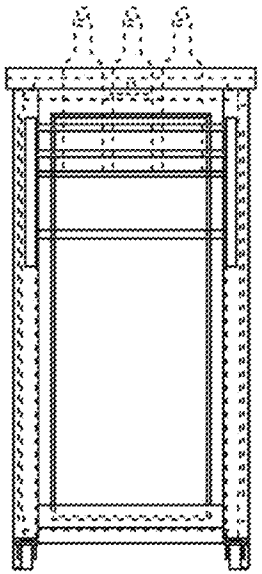
FIG. 6E is a left side view of the exemplary kitchen island shown in FIG. 6A according to certain embodiments.
Figure 6D:
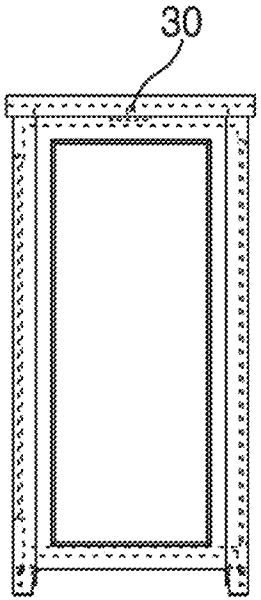
FIG. 6D is a right side view of the exemplary kitchen island shown in FIG. 6A according to certain embodiments.
Figure 6C:
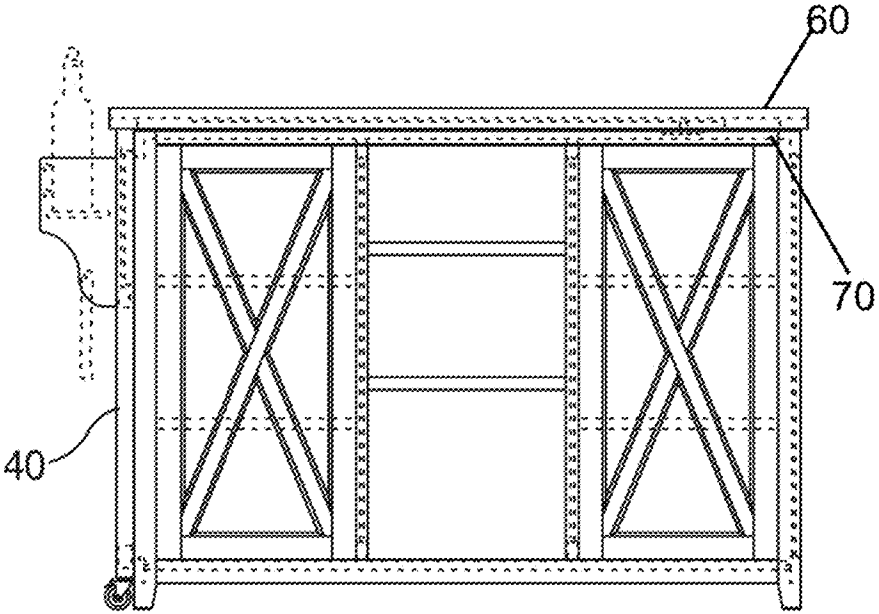
FIG. 6C is a front view of the exemplary kitchen island shown in FIG. 6A according to certain embodiments.

FIGS. 6A-6E illustrate an exemplary kitchen island according to certain embodiments. FIG. 6A is a top plan view of the kitchen island. FIG. 6B is a rear view of the kitchen island. FIG. 6C is a front view of the kitchen island. FIG. 6D is a right side view of the kitchen island. FIG. 6E is a left side view of the kitchen island.

Figure 9A:
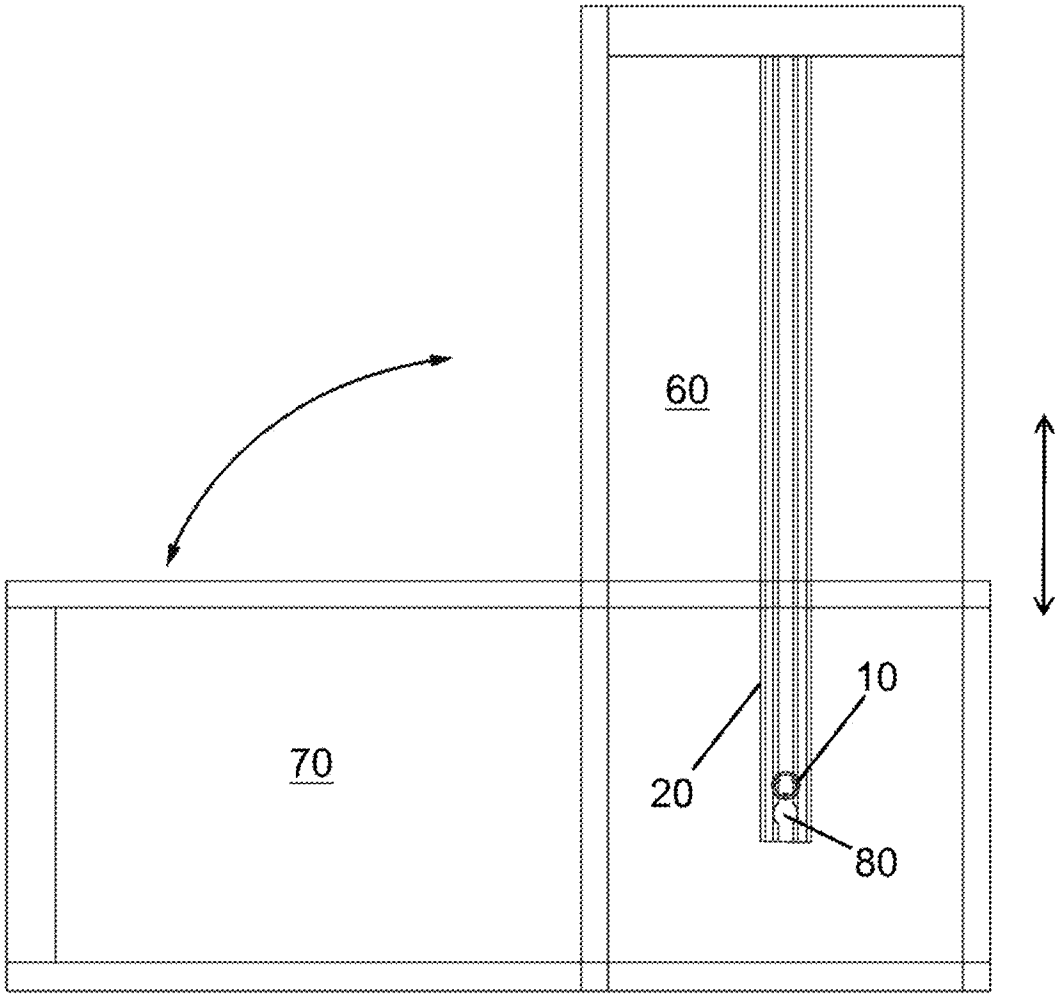
FIG. 9A is a top plan view of a bar unit that includes a pet crate according to certain embodiments.
Figure 9C:
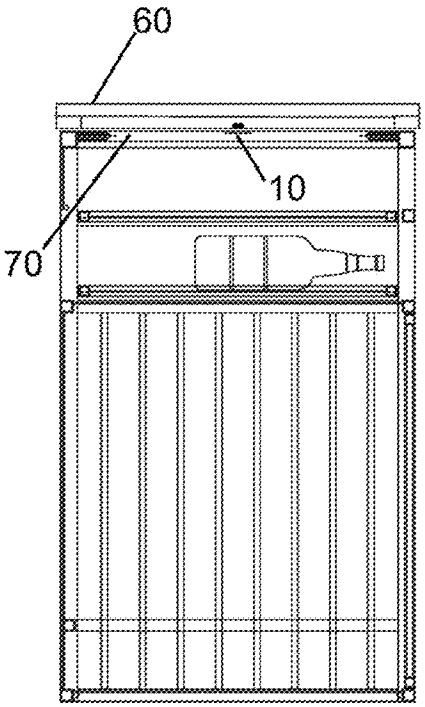
FIG. 9C is a left side view of the bar unit shown in FIG. 9A according to certain embodiments.
Figure 9B:
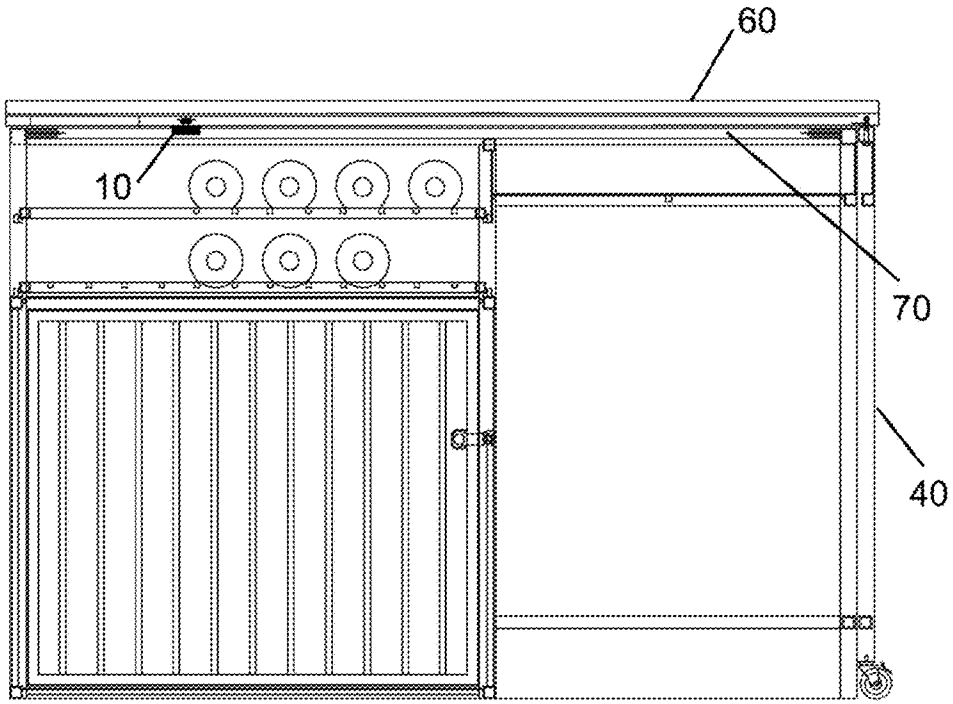
FIG. 9B is a front view of the bar unit shown in FIG. 9A according to certain embodiments.
Figure 9D:
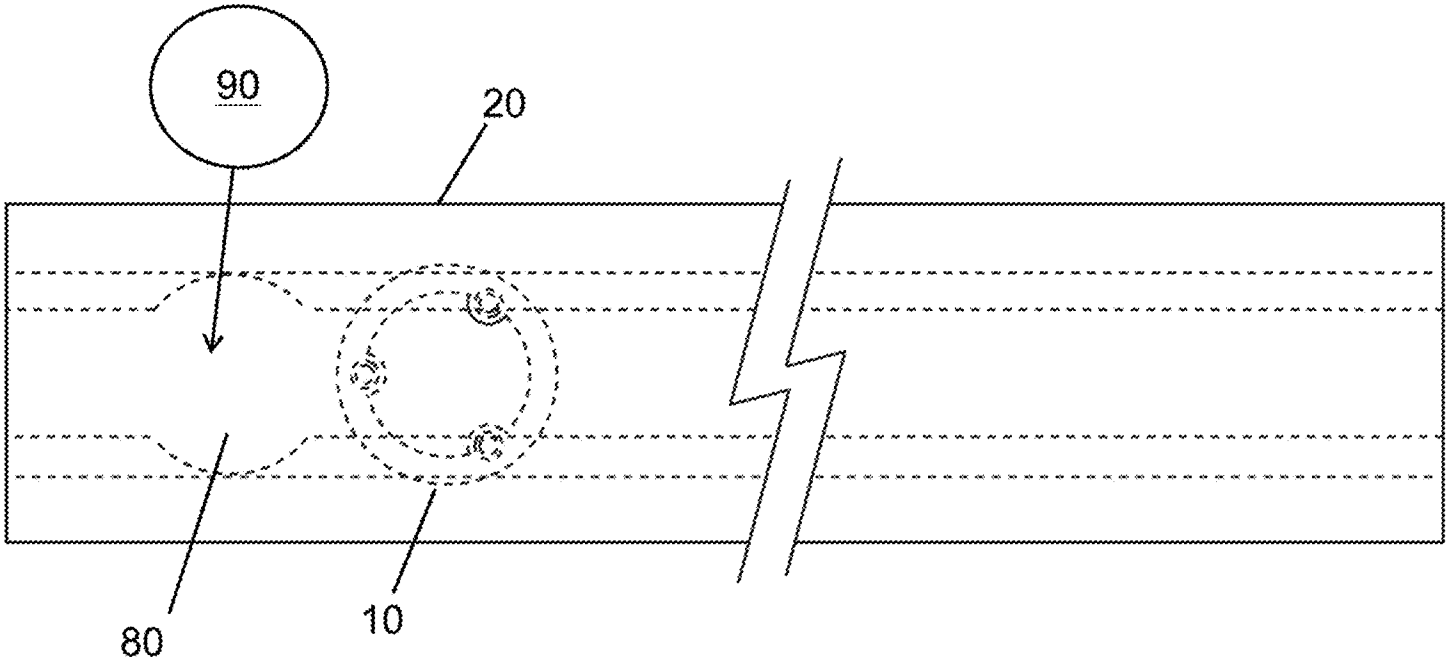
FIG. 9D is a top plan view of an exemplary channel guide and rotational plate according to certain embodiments.

FIGS. 9A-9C illustrate an exemplary bar unit that includes a pet crate according to certain embodiments. FIG. 9A is a top plan view of the bar unit that includes the pet crate. In FIG. 9A, the top panel 60 has been rotated to a 90 degree angle to expose a top surface of the bottom panel. FIG. 9B is a front view of the bar unit that includes the pet crate. FIG. 9C is a right side view of the bar unit that includes the pet crate.

Certain aspects in FIGS. 1A-1C, 2A-2C, 3A-3D, 4A-4D, 5A-5C, 6A-6E, and 9A-9C are shown in broken line to illustrate transparent and/or in cross-sectional views of exemplary expansion systems and features that can be integrated into the furniture items. In some cases, broken lines are also used to illustrate how top panels can be rotated.

Each of the exemplary furniture products illustrated in the figures includes a rotational plate 10 that couples together a top panel 60 and a bottom panel 70 of the furniture product. More specifically, each of the furniture products includes a top surface that is comprised of a top panel 60 and bottom panel 70. The rotational plates 10 include a base portion that is incorporated into the bottom panels 70. Each of the rotational plates 10 also include a coupling portion 30 that extends into the top panels 60 and couples the top panels 60 to the bottom panels 70. In certain embodiments, the top panels 60 are able to completely rotate around the coupling portion 30 with a 360-degree range of motion and beyond.

FIGS. 1A, 2A, 3A, 4A, 5A, 6A and 9A illustrate how the top panel 60 can be rotated. For example, the furniture products illustrated in these figures can be arranged in a compacted configuration identified by Position A. In the compacted configuration, the top panels 60 are situated on top of the bottom panels 70. The top panels 60 can be rotated to arrange the furniture products into an expanded configuration identified by Position B. In these figures, the top panel 60 is shown as being rotated to an expanded configuration that arranges the top panel 60 at a 90-degree angle with respect to the bottom panel 70, thus configuring the furniture items into an L-shaped configuration. It should be recognized that the top panels 60 can be arranged at any angle with respect to the bottom panels 70. For example, the top panels 60 may be further rotated to be situated at a 180-degree angle (thus, configuring the furniture products into an I-shaped configuration), a 270-degree angle (thus, configuring the furniture products into an inverse L-shaped configuration), and/or any other angle. The rotational movement of the top panel 60 is labeled Movement A in FIG. 1A.

When the furniture products are arranged in an expanded configuration, at least a portion of the bottom panel 70 is exposed and provides additional surface area that can be used (e.g., to rest items, to cook food, to seat individuals, etc.). The distal end of the top panel 60, which is located away from the bottom panel 70, can include one or more support members 40. These additional support members 40 can include legs and/or other structures that extend to the floor to support the top panel 60 when the furniture items are arranged in the expanded configuration. As shown, the additional support members 40 can include wheels and/or other structures that facilitate movement along the surface of the floor surface when the top panel 60 is being moved into position.

The channel guides 20 included on the bottom surfaces of the top panels receive the coupling portion 30 of the rotational plates 10, and this loosely coupled connection permits the top panels 60 to move back and forth along the channel guides 20. For example, consider the 90-degree configuration of the furniture items as indicated by Position B in FIGS. 1A, 2A, 3A, 4A, 5A, 6A and 9A. After the top panels 60 of the furniture items have been rotated to this angle, the channel guide 20 enables the top panel 60 to be pushed towards the bottom panel 70 (thus, creating a T-shaped configuration) and/or pulled away from the bottom panel (thus, extending the L-shaped configuration). The channel guide 20 permits this type of movement for any desired angle. For example, if the top panel 60 was rotated 180 degrees (thus, creating an I-shaped configuration), the channel guide 20 would permit the top panel 60 to be pushed towards the bottom panel 70 (thus, shrinking the size of the I-shaped configuration and causing the top panel 60 to further overlap the bottom panel) and/or pulled away from the bottom panel 70 (thus, expanding the size of the I-shaped configuration and lessening the overlap of the top and bottom panels). The movement of the top panel 60 along the channel guide 20 is labeled Movement B in FIG. 1A.

Figure 7A:
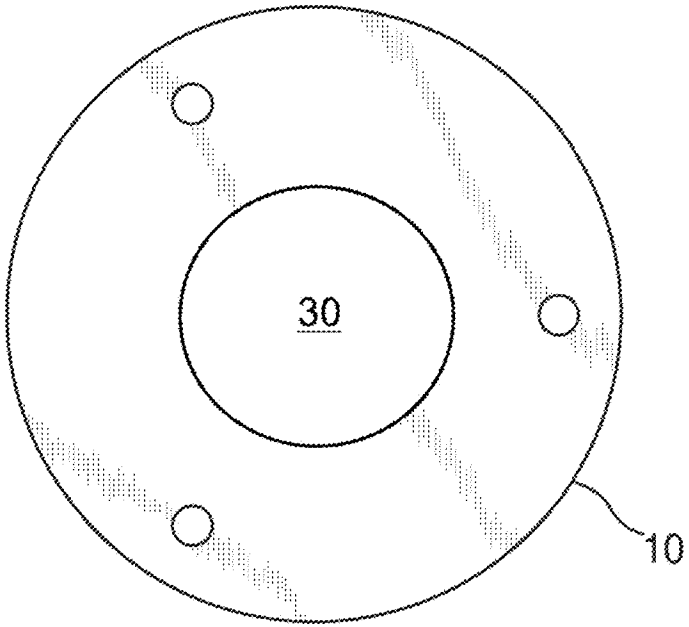
FIG. 7A is a top plan view of an exemplary rotational plate according to certain embodiments.
Figure 7B:
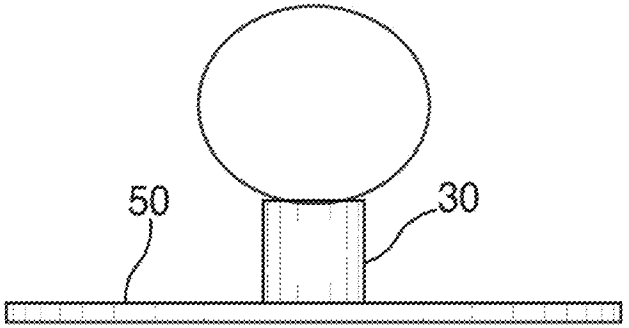
FIG. 7B is a front view of the exemplary rotational plate shown in FIG. 7A according to certain embodiments.

FIGS. 7A-7B illustrate an exemplary rotational plate 10 according to certain embodiments. FIG. 7A is a top plan view of the rotational plate 10. FIG. 7B is a front view of the rotational plate 10.

In this exemplary embodiment, the rotational plate 10 includes a circular base portion 50 and a circular coupling portion 30. The rotational plate 10 includes one or more holes for fastening the rotational plate 10 to the bottom panel of a furniture product (e.g., using screws, bolts, and/or nails). The rotational plate 10 also includes a coupling portion 30 that extends into channel guide 20 of the top panel 60 and couples the top panel 60 to the bottom panel 70. The coupling portion 30 includes a spherical top portion that is connected to the base portion 50 by an extension having a smaller diameter or width. The diameter or width of the extension portion enables the extension to fit through a recess in the channel guide 20. The coupling between the rotational plate and the channel guide included on the top panel 60 enables the top panel 60 move along the channel guide 20 and to rotate about the axis that extends through the center of the coupling portion 30 and/or circular base portion 50.

Figure 8A:
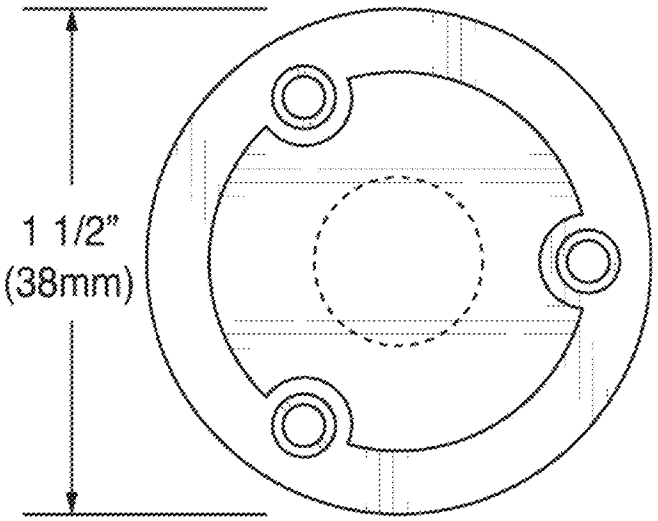
FIG. 8A is a top plan view of another exemplary rotational plate according to certain embodiments.
Figure 8B:
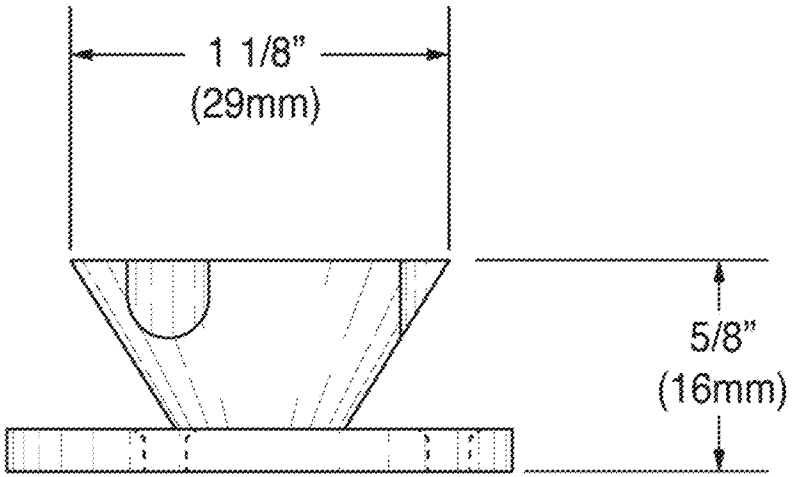
FIG. 8B is a front view of the exemplary rotational plate shown in FIG. 8A according to certain embodiments.

FIGS. 8A-8B illustrate another exemplary rotational plate 10 according to certain embodiments. FIG. 8A is a top plan view of the rotational plate 10. FIG. 8B is a front view of the rotational plate 10.

In this exemplary embodiment, the rotational plate 10 includes a circular base portion 50 and a conical or V-shaped coupling portion 30. The rotational plate 10 includes one or more holes for fastening the rotational plate 10 to the bottom panel of a furniture product (e.g., using screws, bolts, and/or nails). The conical or V-shaped coupling portion 30 can extend into channel guide 20 located on the top panel 60 and to couple the top panel 60 to the bottom panel 70. The top panel 60 is configured to rotate about the axis that extends through the center of the coupling portion 30 and/or circular base portion 50. The top panel can also move in a direction along the channel guide 20.

Figure 10A:
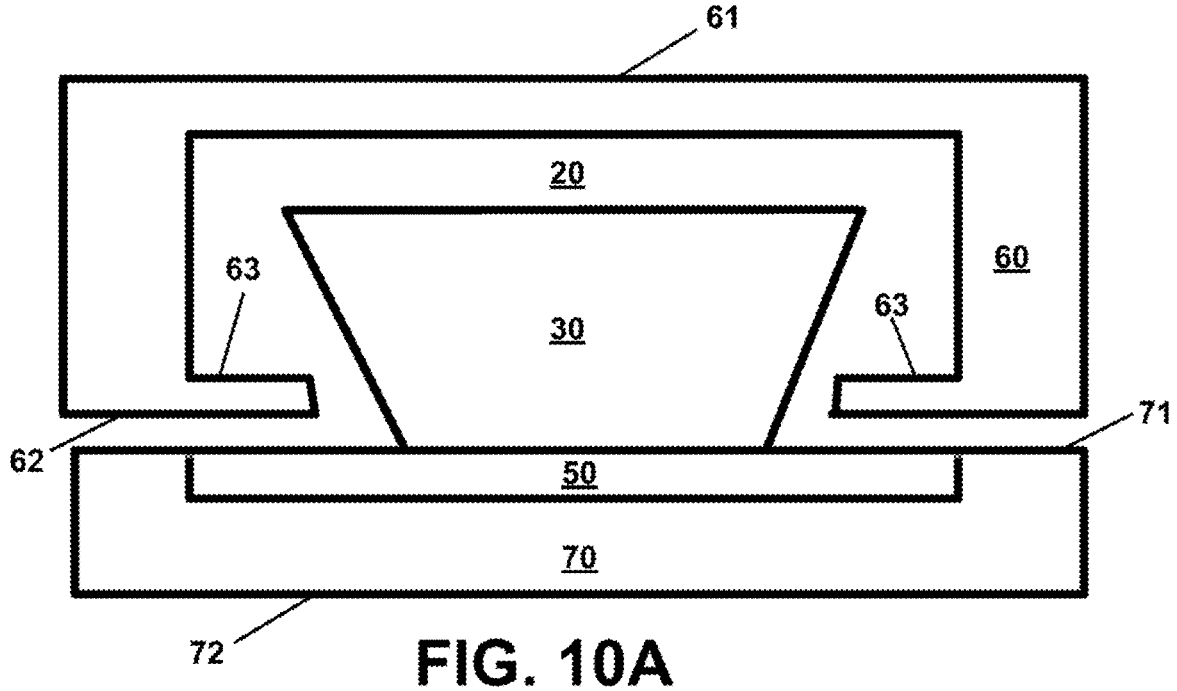
FIG. 10A is a cross-sectional view showing an exemplary connection scheme including a rotational plate and channel guide according to certain embodiments.
Figure 10B:
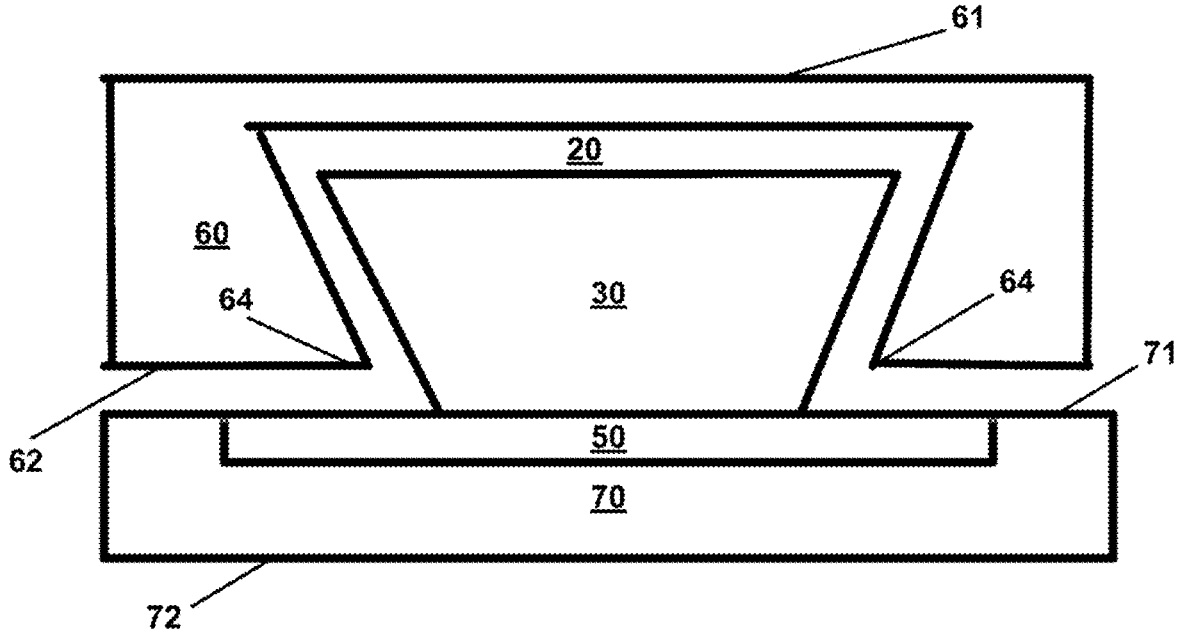
FIG. 10B is a cross-sectional view showing another exemplary connection scheme including a rotational plate and channel guide according to certain embodiments.
Figure 10C:
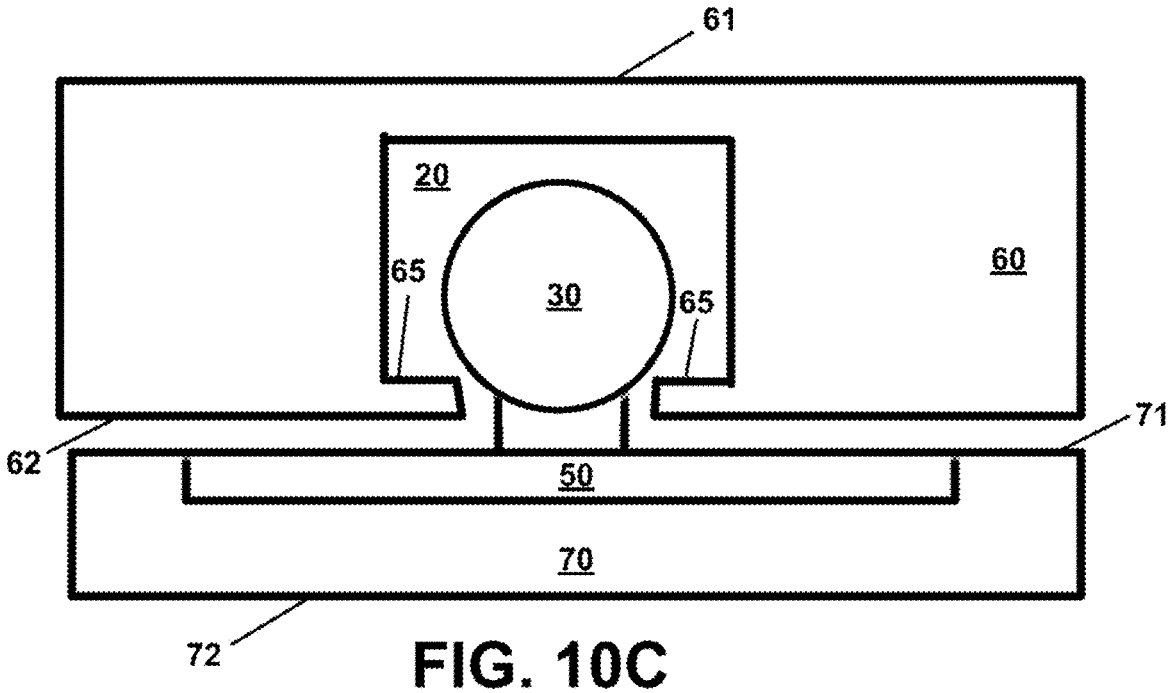
FIG. 10C is a cross-sectional view showing another exemplary connection scheme including a rotational plate and channel guide according to certain embodiments.

FIGS. 10A-10C provide cross-sectional views of exemplary connection schemes that can be used for coupling a top panel 60 to a bottom panel 70 of a furniture product. Any furniture product, including any of the furniture products mentioned in this disclosure, can utilize the exemplary connection schemes illustrated in FIGS. 10A-10C for coupling a top panel 60 to a furniture product.

The top panel 60 has a top surface 61 and a bottom surface 62, and the bottom panel 70 has a top surface 71 and a bottom surface 72. In certain embodiments, the bottom surface 72 of the bottom panel may not be visible. For example, the bottom panel 70 may be integrated into to an upper portion of a furniture product and only the top surface of the bottom panel 70 may be visible when the furniture product is arranged in an expanded configuration.

A base portion 50 of an exemplary rotational plate 10 is integrated into the top surface 71 of the bottom panel 70. A channel guide 20 is included on the bottom surface 62 of the top panel 60. The coupling portion 30 of the rotational plate 10 is received in the channel guide 20. The top panel 60 can rotate about an axis defined by the rotational plate 10 and/or coupling portion 30. The top panel 60 can also slide along the channel guide 20. For example, after the top panel 60 has been rotated to a desired angle, the top panel 60 can be moved back and forth along the channel guide 20 in a plane that is parallel with respect to the underlying floor surface.

In certain embodiments, the channel guide 20 can represent a structure that is attached or connected to the top panel 60. For example, the channel guide 20 can include a track or other structure that is formed of plastic, metal or other material, and which is received in a recess on the bottom surface 62 of top panel 60. Alternatively, the channel guide 20 can be integrated directly into the bottom surface 62 of top panel 60. For example, the channel guide 20 can be carved into the bottom surface 62 of a top panel 60, or the channel guide 20 can be formed in the bottom surface 62 of a top panel 60 when the top panel is fabricated.

The exemplary connection scheme illustrated in FIG. 10A includes an !-shaped channel or track. The bottom portion of the channel guide 20 includes edges 63 that serve to lock and/or secure the coupling portion 30 of the rotational plate 10 in the channel guide 20. The top portion or upper surface of the coupling portion 30 is wider than the gap between the edges 63, thus preventing the coupling portion 30 from being removed or dislodged from the channel guide 20.

The exemplary connection scheme illustrated in FIG. 10B includes a V-shaped channel or track. The bottom portion of the channel guide 20 includes edges 64 that serve to lock and/or secure the coupling portion 30 of the rotational plate 10 in the channel guide 20. The top portion or upper surface of the coupling portion 30 is wider than the gap between the edges 64, thus preventing the coupling portion 30 from being removed or dislodged from the channel guide 20.

The exemplary connection scheme illustrated in FIG. 10C includes an !-shaped channel or track. The coupling portion 30 includes a ball or sphere structure. The bottom portion of the channel guide 20 includes edges 65 that serve to lock and/or secure the coupling portion 30 of the rotational plate 10 in the channel guide 20. The ball or sphere structure of the coupling portion 30 is wider than the gap between the edges 65, thus preventing the coupling portion 30 from being removed or dislodged from the channel guide 20.

In the exemplary connection schemes illustrated in FIGS. 10A-10C, the conical-shaped coupling portion 30 and/or sphere-shaped coupling portion 30 includes an upper portion that is wider than a bottom portion of the channel guide 20 (e.g., which is defined by edges 63, 64 or 65) to assist with securing the coupling portion in the channel guide 20. That is, the coupling portion includes a lower portion that is situated adjacent to the base portion 50, and an upper portion of the coupling portion is situated distally with respect to the base portion 50. The width of the upper portion is greater than the width of the lower portion. The smaller width of the lower portion enables the coupling portion 30 to extend through the gap defined by edges 63, 64, or 65. The increased width of the upper portion prevents the coupling portion 30 from being removed or dislodged from the channel guide 20.

In order to couple the top panel 60 to the bottom panel 70 during assembly of a furniture product, the coupling portion 30 of the rotational plate 10 can be inserted into a hole 80 that is included in the channel guide 20. FIGS. 9A an 9D illustrate exemplary holes 80 that can enable connection of the top panel 60 to the bottom panel 70. A plug 90 can be inserted into the hole 80 after the coupling portion 30 of the rotational plate 10 is inserted into the channel guide 20. The plug 90 can prevent the rotational plate from becoming dislodged from the channel guide 20 during use. The plug 90 can be constructed of rubber, metal, wood, and/or any other appropriate material. It should be understood that the exemplary channel guide 20 and rotational plate 10 illustrated in FIGS. 9A-9D can be integrated into any furniture product including, but not limited to, any of the furniture products that are illustrated in the other figures.

The rotational plate 10 can be configured to connect the top panel 60 to the bottom panel 60 using other types of connection schemes. For example, in certain embodiments, the rotational plate 10 can be incorporated into the top panel 60 and the coupling portion 30 may extend downward into a channel guide that is integrated into the bottom panel 70 to attach the panels to one another.

FIGS. 11A-11E illustrate top plan views of an exemplary furniture product that demonstrate how the top panel 60 can be moved to arrange the furniture product in various configurations. Any furniture product, including any of the furniture products described in this disclosure, can be transformed into the configurations illustrated in these figures.

Figure 11C:
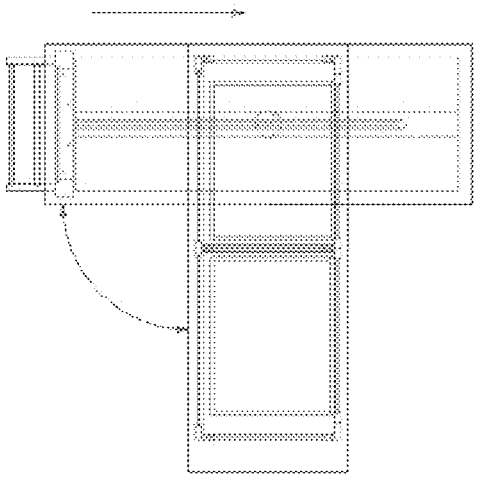
FIG. 11C is a top plan view showing an exemplary furniture product with a top panel arranged in a third configuration according to certain embodiments.
Figure 11B:
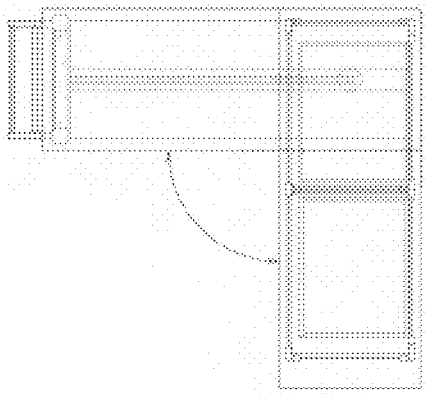
FIG. 11B is a top plan view showing an exemplary furniture product with a top panel arranged in a second configuration according to certain embodiments.
Figure 11A:
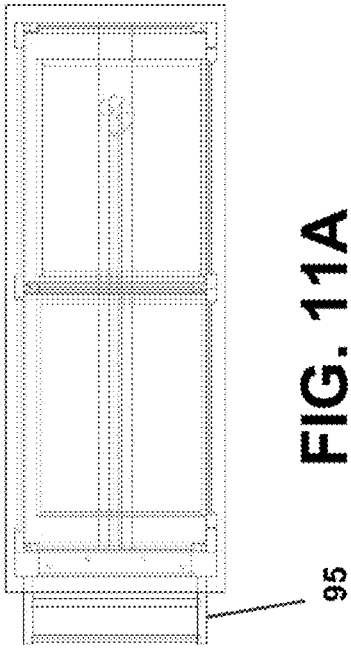
FIG. 11A is a top plan view showing an exemplary furniture product with a top panel arranged in a first configuration according to certain embodiments.
Figure 11D:
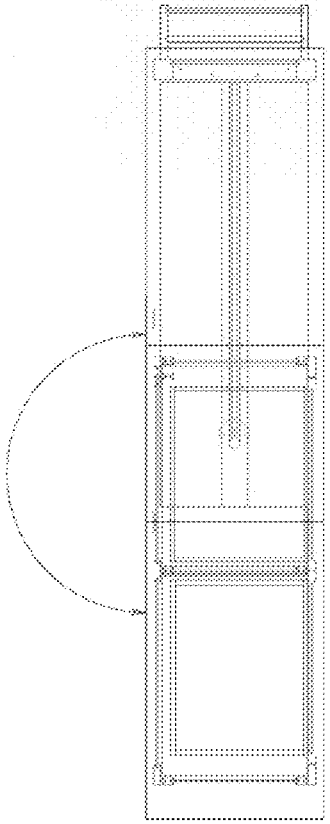
FIG. 11D is a top plan view showing an exemplary furniture product with a top panel arranged in a fourth configuration according to certain embodiments.

FIG. 11A illustrates a first configuration in which the top panel 60 is situated directly on top of a bottom panel 70, thus concealing the top surface 71 of the bottom panel 70 and providing a space-saving arrangement. FIG. 11B illustrates a second configuration in which the top panel 60 is rotated 90 degrees with respect to the first configuration shown in FIG. 11A, thus forming an L-shaped configuration. After the top panel is rotated 90 degrees as shown in FIG. 11B, the top panel 60 can be moved along the direction of the channel guide 20 to form a T-shaped configuration, as illustrated in FIG. 11C. FIG. 11D illustrates a fourth configuration in which the top panel 60 is rotated 180 degrees with respect to the first configuration shown in FIG. 11A, thus forming an I-shaped configuration. After the top panel is rotated 180 degrees as shown in FIG. 11D, the top panel 60 can be moved along the direction of the channel guide 20, as illustrated in FIG. 11E, such that the top panel 60 is situated directly on top of a bottom panel 70.

It should be evident that the furniture product can be arranged in various other configurations using the connection scheme described herein. For example, the top panel can be rotated 270 degrees with respect to the first configuration shown in FIG. 11A. This would result in an L-shaped configuration (similar to FIG. 11B, but having the top panel extending downward instead of upward). Likewise, after top panel is rotated 270 degrees with respect to the first configuration shown in FIG. 11A, the top panel 60 can be moved towards the furniture product along the channel guide 20 to form a T-shaped configuration (similar to FIG. 11C). The top panel can also be rotated 360 to arrive back at the configuration in FIG. 1A.

Figure 11E:
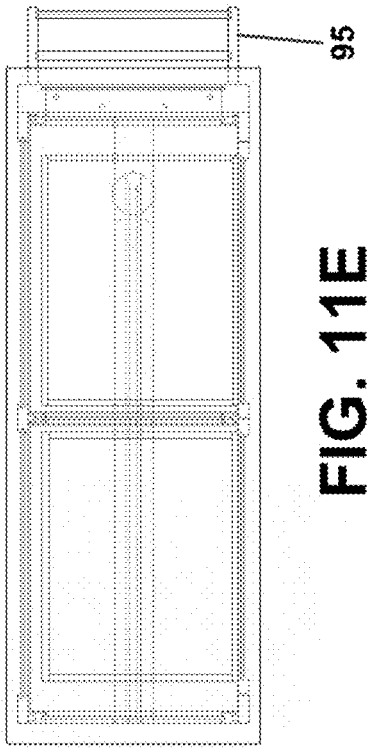
FIG. 11E is a top plan view showing an exemplary furniture product with a top panel arranged in a fifth configuration according to certain embodiments.

The exemplary furniture product in FIGS. 11A-11E includes a towel rack 95. As demonstrated by FIGS. 11A and 11E, the connection scheme that connects the top panel 60 to the furniture product enables the top panel to be reversed or flipped. Thus, the towel rack 95 in FIG. 11A is arranged on the left side of the furniture product, and the towel rack 95 in FIG. 11E is shown on the right side of the furniture product (after the top panel is rotated 180 degrees and pushed towards the furniture product along the channel guide).

It should be recognized that numerous variations can be made to the above-described systems and methods without departing from the scope of the invention.

While various novel features of the invention have been shown, described, and pointed out as applied to particular embodiments thereof, it should be understood that various omissions, substitutions and changes in the form and details of the systems and methods described and illustrated may be made by those skilled in the art without departing from the spirit of the invention. Amongst other things, the steps shown in the methods may be carried out in different orders in many cases, where such may be appropriate. Those skilled in the art will recognize, based on the above disclosure and an understanding therefrom of the teachings of the invention, that the particular hardware and devices that are part of the system described herein, and the general functionality provided by and incorporated therein, may vary in different embodiments of the invention. Accordingly, the particular system components are for illustrative purposes to facilitate a full and complete understanding and appreciation of the various aspects and functionality of particular embodiments of the invention, as realized in system and method embodiments thereof. Those skilled in the art will appreciate that the invention can be practiced in other than the described embodiments, which are presented for purposes of illustration and not limitation.

What is claimed is:

1. A furniture product comprising:

an expandable surface that includes:

a stationary bottom panel;

a top panel that is situated above the bottom panel when the furniture product is arranged in a compacted configuration, and the top panel is moveable to transform the furniture product into an expanded configuration;

wherein:

a bottom surface of the top panel includes a channel guide comprising a single, continuous groove located in a center of the bottom surface and extending substantially a length of the bottom surface;

a top surface of the bottom panel includes a rotational plate;

the rotational plate includes a coupling portion that is received in the channel guide of the top panel to couple the bottom panel and the top panel;

the rotational plate includes a base portion that couples the rotational plate to the bottom panel;

the coupling portion of the rotational plate includes an extension portion that is situated adjacent to the base portion, the extension portion extending upwardly from the base portion into the channel guide;

the coupling portion includes a top portion that is secured in the channel guide, wherein a width of the top portion is greater than a width of the extension portion and greater than a width of an opening in the channel guide;

a connection between the channel guide on the top panel and the rotational plate enables the top panel to be moved between the compacted configuration and the expanded configuration;

the connection between the rotational plate and the channel guide enables the top panel to rotate about an axis extending through the rotational plate, and further enables the top panel to move along the channel guide in a plane that is substantially parallel to a floor surface supporting the furniture product;

the connection between the rotational plate on the bottom panel and the channel guide on the top panel enables reversing a position of the top panel, wherein reversing the position of the top panel includes rotating the top panel 180 degrees and then moving the top panel along the channel guide in a direction toward the bottom panel; and the connection between the rotational plate on the bottom panel and the channel guide on the top panel enables arranging the furniture product in a T-shaped configuration, wherein arranging the furniture product in the T-shaped configuration includes rotating the movable top panel 270 degrees and then moving the top panel along the channel guide in a direction toward the bottom panel.

2. The furniture product of claim 1, wherein the channel guide includes a hole that is wider than the top portion of the coupling portion to enable insertion of the coupling portion into the channel guide.

3. The furniture product of claim 2, wherein the hole is fitted with a plug to assist with securing the coupling portion in the channel guide.

4. The furniture product of claim 1, wherein:

the top panel includes one or more support structures that extend downward from the top panel to provide assistance with supporting the top panel when the top panel is arranged in the expanded configuration; and the one or more support structures each include a wheel or a glide member that facilitates movement along a floor surface.

5. The furniture product of claim 1, wherein the connection between the rotational plate and the channel guide enables the furniture product to be arranged in an L-shaped configuration, the T-shaped configuration, and an I-shaped configuration.

6. The furniture product of claim 1, wherein the furniture product is one of: a bar unit; a table; a kitchen island; an item that includes a pet crate; or a desk.

7. The furniture product of claim 1, wherein the connection enables the top panel to be rotated about the axis to an angle and, after being rotated to the angle, moved in a direction along the channel guide toward and away from the rotational plate.

8. A furniture product comprising:

a stationary bottom panel; and a top panel that is situated above the bottom panel when the furniture product is arranged in a compacted configuration, and the top panel is moveable to transform the furniture product into an expanded configuration;

wherein:

a bottom surface of the top panel includes a channel guide comprising a single, continuous groove located in a center of the bottom surface and extending substantially a length of the bottom surface;

a top surface of the bottom panel includes a rotational plate;

the rotational plate includes a coupling portion that is received in the channel guide of the top panel to couple the bottom panel and the top panel; and the rotational plate includes a base portion that couples the rotational plate to the bottom panel;

the coupling portion of the rotational plate includes an extension portion that is situated adjacent to the base portion, the extension portion extending upwardly from the base portion into the channel guide;

the coupling portion includes a top portion that is secured in the channel guide, wherein a width of the top portion is greater than a width of the extension portion and greater than a width of an opening in the channel guide;

a connection between the channel guide and the rotational plate enables the top panel to be moved between the compacted configuration and the expanded configuration;

the connection between the rotational plate on the bottom panel and the channel guide on the top panel enables reversing a position of the top panel, wherein reversing the position of the top panel includes rotating the top panel 180 degrees and then moving the top panel along the channel guide in a direction toward the bottom panel; and the connection between the rotational plate on the bottom panel and the channel guide on the top panel enables arranging the furniture product in a T-shaped configuration, wherein arranging the furniture product in the T-shaped configuration includes rotating the movable top panel 270 degrees and then moving the top panel along the channel guide in a direction toward the bottom panel.

9. The furniture product of claim 8, wherein the rotational plate enables the top panel to rotate about an axis extending through a center portion of the rotational plate.

10. The furniture product of claim 9, wherein the top panel can further move along the channel guide in a plane that is substantially parallel to a floor surface supporting the furniture product.

11. The furniture product of claim 8, wherein the channel guide includes a hole that is wider than the top portion of the coupling portion to enable insertion of the coupling portion into the channel guide.

12. The furniture product of claim 11, wherein the hole is fitted with a plug to assist with securing the coupling portion in the channel guide after the coupling portion is inserted into the channel guide.

13. The furniture product of claim 8, wherein:

the top panel includes one or more support structures that extend downward from the top panel to provide assistance with supporting the top panel when the top panel is arranged in the expanded configuration; and the one or more support structures each include a wheel or a glide member that facilitates movement along a floor surface.

14. The furniture product of claim 8, wherein the connection between the rotational plate and the channel guide enables the furniture product to be arranged in an L-shaped configuration, the T-shaped configuration, and an I-shaped configuration.

15. The furniture product of claim 8, wherein the furniture product is one of: a bar unit; a table; a kitchen island; an item that includes a pet crate; or a desk.

16. A furniture product comprising:

a stationary portion that rests on a floor surface;

an expandable surface that includes:

a stationary bottom panel situated on top of the stationary portion;

a movable top panel that is situated above the stationary bottom panel when the furniture product is arranged in a compacted configuration, wherein the movable top panel enables the furniture product to transform into an expanded configuration;

wherein:

a bottom surface of the movable top panel includes a channel guide comprising a single, continuous groove located in a center of the bottom surface and extending substantially a length of the bottom surface;

a top surface of the stationary bottom panel includes a rotational plate;

the rotational plate includes a coupling portion that is received in the channel guide of the movable top panel to couple the stationary bottom panel and the movable top panel;

the rotational plate includes a base portion that couples the rotational plate to the stationary bottom panel;

the coupling portion of the rotational plate includes an extension portion that is situated adjacent to the base portion, the extension portion extending upwardly from the base portion into the channel guide;

the coupling portion includes a top portion that is secured in the channel guide, wherein a width of the top portion is greater than a width of the extension portion and greater than a width of an opening in the channel guide;

a connection between the channel guide on the movable top panel and the rotational plate on the stationary bottom panel enables the movable top panel to be moved between the compacted configuration and the expanded configuration;

the connection between the rotational plate on the stationary bottom panel and the channel guide on the movable top panel enables the movable top panel to rotate about an axis extending through the rotational plate, and further enables the movable top panel to move along the channel guide in a plane that is substantially parallel to the floor surface supporting the furniture product;

the connection between the rotational plate on the stationary bottom panel and the channel guide on the movable top panel enables the movable top panel to be rotated about to the axis to an angle and, after being rotated to the angle, moved in a direction along the channel guide toward and away from the stationary portion of the furniture product;

the connection between the rotational plate on the stationary bottom panel and the channel guide on the movable top panel enables reversing a position of the movable top panel, wherein reversing the position of the movable top panel includes rotating the movable top panel 180 degrees and then moving the movable top panel along the channel guide in a direction toward the stationary bottom panel; and the connection between the rotational plate on the stationary bottom panel and the channel guide on the movable top panel enables arranging the furniture product in a T-shaped configuration, wherein arranging the furniture product in the T-shaped configuration includes rotating the movable top panel 270 degrees and then moving the movable top panel along the channel guide in a direction toward the stationary bottom panel.

* * * * *